US010570678B2

(12) United States Patent
Moss et al.

(10) Patent No.: US 10,570,678 B2
(45) Date of Patent: Feb. 25, 2020

(54) HORSESHOE SLIP ELEVATOR

(71) Applicant: Frank's International, LLC, Houston, TX (US)

(72) Inventors: Alfred Moss, Lafayette, LA (US); Nicholas Guidry, Breaux Bridge, LA (US); Logan Smith, Lafayette, LA (US); Dax Joseph Neuville, Broussard, LA (US)

(73) Assignee: FRANK'S INTERNATIONAL, LLC, Houston, TX (US)

( * ) Notice: Subject to any disclaimer, the term of this patent is extended or adjusted under 35 U.S.C. 154(b) by 39 days.

(21) Appl. No.: 15/718,925

(22) Filed: Sep. 28, 2017

(65) Prior Publication Data

US 2018/0100359 A1 Apr. 12, 2018

Related U.S. Application Data

(60) Provisional application No. 62/407,018, filed on Oct. 12, 2016.

(51) Int. Cl.

| | |
|---|---|
| ***E21B 19/07*** | (2006.01) |
| ***E21B 19/10*** | (2006.01) |
| ***E21B 19/06*** | (2006.01) |
| ***E21B 3/02*** | (2006.01) |
| ***E21B 19/20*** | (2006.01) |
| ***E21B 19/15*** | (2006.01) |
| *E21B 19/16* | (2006.01) |

(52) U.S. Cl.

CPC ..... *E21B 19/07* (2013.01); *E21B 3/02* (2013.01); *E21B 19/06* (2013.01); *E21B 19/10* (2013.01); *E21B 19/155* (2013.01); *E21B 19/20* (2013.01); *E21B 19/16* (2013.01)

(58) Field of Classification Search

CPC ..... E21B 19/07

See application file for complete search history.

(56) References Cited

U.S. PATENT DOCUMENTS 1,558,261 A * 10/1925 Grady ..... E21B 19/06 294/91
1,656,582 A * 1/1928 Harder ..... E21B 19/06 294/91
2,203,118 A * 6/1940 Williams ..... E21B 19/06 294/90

(Continued)

OTHER PUBLICATIONS

Jin Ho Kim (Authorized Officer), International Search Report and Written Opinion dated Jan. 25, 2018, PCT Application No. PCT/US2017/055491, filed Oct. 6, 2017, pp. 1-17.

(Continued)

*Primary Examiner* — Giovanna C Wright

(74) *Attorney, Agent, or Firm* — MH2 Technology Law Group LLP

(57) ABSTRACT

An apparatus for gripping a tubular includes a body. A slip carrier is coupled to an inner surface of the body. The slip carrier is configured to pivot between an open position and a closed position. A tubular is configured to be introduced laterally into the body when the slip carrier is in the open position. A slip is coupled to the slip carrier. The slip is configured to move radially between a first position that is spaced apart from the tubular and a second position that contacts and grips the tubular.

21 Claims, 20 Drawing Sheets

(56) References Cited

U.S. PATENT DOCUMENTS

| | | | | |
|---|---|---|---|---|
| 8,632,111 | B2 | 1/2014 | Krijnen | |
| 2007/0261857 | A1 | 11/2007 | Kuttel | |
| 2008/0060818 | A1 | 3/2008 | Bourgeois et al. | |
| 2008/0277108 | A1 | 11/2008 | Bouligny, Jr. et al. | |
| 2010/0319932 | A1* | 12/2010 | Angelle | B66C 1/12 166/380 |
| 2012/0085550 | A1 | 4/2012 | Robichaux et al. | |
| 2014/0090856 | A1 | 4/2014 | Pratt | |
| 2015/0159444 | A1 | 6/2015 | Stankovic | |
| 2015/0240575 | A1* | 8/2015 | Angelle | E21B 19/06 166/382 |

OTHER PUBLICATIONS

Athina Nickitas-Etienne (Authorized Officer), International Preliminary Report on Patentability dated Apr. 25, 2019, PCT Application No. PCT/US2017/055491, pp. 1-14.

Giovanna C. Wright, Non-Final Office Action dated Nov. 1, 2019, U.S. Appl. No. 16/258,859, pp. 1-22.

* cited by examiner

HORSESHOE SLIP ELEVATOR

CROSS-REFERENCE TO RELATED APPLICATIONS

This application claims priority to U.S. Provisional Patent Application No. 62/407,018, filed on Oct. 12, 2016, the entirety of which is incorporated herein by reference.

BACKGROUND

Elevators are used in the oilfield industry for handling tubulars on drilling rigs. Some elevators include a body made up of two semi-circular portions that are hinged together and fitted around a tubular. A latch or connecting pin may be positioned opposite of the hinge to secure the semi-circular portions together. When disengaged, the latch or connecting pin allows for the semi-circular portions to be pivoted apart. Another type of elevator is in the shape of a horseshoe. Horseshoe-shaped elevators generally do not require disengaging a latch or connecting pin and pivoting the semi-circular portions apart to place the elevator around the tubular.

Horseshoe-shaped elevators are generally designed to support a tubular by lifting on the lower load face of a coupling that has been connected ("made up") to the tubular. The coupling has a bore formed therethrough and female threads on an inner surface thereof. The coupling is designed to have two tubulars inserted into the bore through opposing ends of the coupling. Male threads on the tubulars may engage corresponding female threads of the coupling to join the tubulars together. As such, the outer diameter of the coupling is larger than the outer diameter of the tubulars. Thus, an upper surface of the elevator may contact a lower surface of the coupling, thereby allowing the elevator to support the weight of the tubular.

When no coupling is used, a lifting apparatus (often referred to as a "lift nubbin" or "lift plug") is coupled to the tubular. The lifting apparatus includes a male threaded end that engages the female threads in the tubular. The lifting apparatus includes a flange portion on the outer diameter thereof that is larger than the outer diameter of the tubular. The elevator may contact a lower surface of the flange, thereby allowing the elevator to support the weight of the tubular. Attaching and removing lifting apparatuses, however, lengthens time taken to deploy each tubular into the well, as the lifting apparatus generally have to be installed and then removed before the tubular is made up to the next tubular.

As shown in FIGS. 19 and 20, a clamp-type elevator 1900 was created to avoid the use of lifting apparatuses. The clamp-type elevator 1900 includes tapered slips that are fitted with gripping inserts that are configured to radially-grip the outer diameter of the tubular. At least one of the slips 1911, 1912 is spring-biased upward, and at least one of the slips 1913, 1914 is pneumatically powered up and down. The operation of the clamp-type elevator 1900 involves laterally moving the elevator onto the tubular to be lifted. The front slip arms 1930, 1931 pivot about shafts 1940, 1941 into the deployed position shown in FIG. 19 and move the pneumatic slip(s) 1913, 1914 downward into initial engagement with the tubular 1920. As the tubular 1920 is lifted, the spring-biased slip(s) 1911, 1912 are drawn downward into increased radial gripping engagement with the tubular 1920.

In certain applications, the spring-biased slip(s) 1911, 1912 are drawn downward into contact with the tubular 1920 to be lifted prior to the pneumatic slips 1913, 1914 being energized. When this occurs, the spring-biased slip(s) 1911, 1912 may mechanically overload and fracture a mechanical stop that is designed to stop movement of the spring-biased slip(s) 1911, 1912 at the end of their downward stroke. Once this occurs, the slip becomes separated from the clamp-type elevator 1900 and becomes a dropped object. In some instances, this may cause the tubular 1920 to be dropped. The apparatus disclosed herein actuates all slips by means of powered actuators which are connected to the slips by means of a timing ring ensuring that all slips move in unison with each other.

SUMMARY

An apparatus for gripping a tubular is disclosed. The apparatus includes a body. A slip carrier is coupled to an inner surface of the body. The slip carrier is configured to pivot between an open position and a closed position. A tubular is configured to be introduced laterally into the body when the slip carrier is in the open position. A slip is coupled to the slip carrier. The slip is configured to move radially between a first position that is spaced apart from the tubular and a second position that contacts and grips the tubular.

In a preferred embodiment, the apparatus includes a U-shaped body. A slip carrier is coupled to an inner surface of the body. The slip carrier is configured to pivot with respect to the body between an open position and a closed position. A tubular is configured to be introduced laterally into the body when the slip carrier is in the open position. The tubular being introduced laterally into the body causes the slip carrier to pivot into the closed position. A slip carrier locking pin is configured to secure the slip carrier in the closed position. The slip carrier locking pin is configured to move through a first hole formed through the body and a second hole formed through the slip carrier. The first and second holes are aligned when the slip carrier is in the closed position. A tapered slip is coupled to the slip carrier and is also linked to the timing ring. Movement of the timing ring causes the slip to move vertically and radially between a first position in which the slip is spaced apart from the tubular and a second position in which the slip contacts and grips the tubular. A pneumatic cylinder is coupled to the body and moves a main timing ring up and down. A slip position indicator rod is configured to move downward together with the main timing ring. An indicator ramp is coupled to and configured to move together with the slip position indicator rod. A slip position indicator valve is coupled to the body. Movement of the indicator ramp past the slip position indicator valve causes a signal to be transmitted indicating that the slip is in the second position.

A method for moving one or more tubulars is disclosed. The method includes positioning an apparatus at least partially around a first tubular. The method also includes actuating the slip carrier into a closed and locked position. The method also includes actuating a slip that is coupled to the slip carrier from a first position into a second position to grip the first tubular. The method further includes lifting the first tubular into a substantially vertical orientation using a top drive that is coupled to the apparatus while the first tubular is gripped by the apparatus.

The foregoing summary is intended merely to introduce a subset of the features more fully described of the following detailed description. Accordingly, this summary should not be considered limiting.

BRIEF DESCRIPTION OF THE DRAWINGS

The accompanying drawing, which is incorporated in and constitutes a part of this specification, illustrates an embodiment of the present teachings and together with the description, serves to explain the principles of the present teachings. In the figures.

Figure 1:
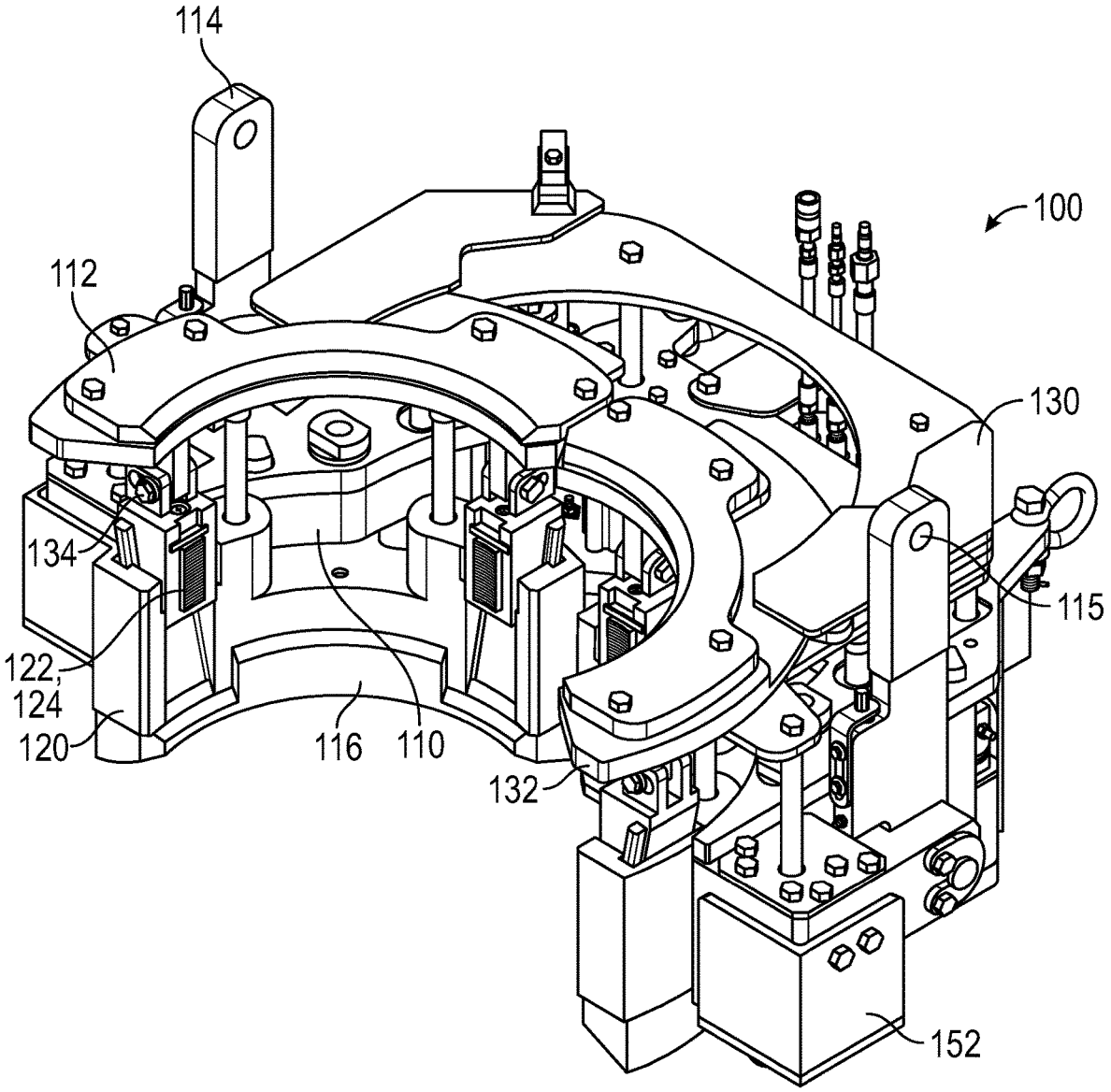
FIG. 1 illustrates a perspective view of an apparatus for gripping a tubular, showing slip carriers thereof in an open position and slips thereof in an up position, according to an embodiment.

It should be noted that some details of the figure have been simplified and are drawn to facilitate understanding of the embodiments rather than to maintain strict structural accuracy, detail, and scale.

DETAILED DESCRIPTION

Reference will now be made in detail to embodiments of the present teachings, examples of which are illustrated in the accompanying drawing. In the drawings, like reference numerals have been used throughout to designate identical elements, where convenient. In the following description, reference is made to the accompanying drawing that forms a part thereof, and in which is shown by way of illustration a specific exemplary embodiment in which the present teachings may be practiced. The following description is, therefore, merely exemplary.

Figure 2:
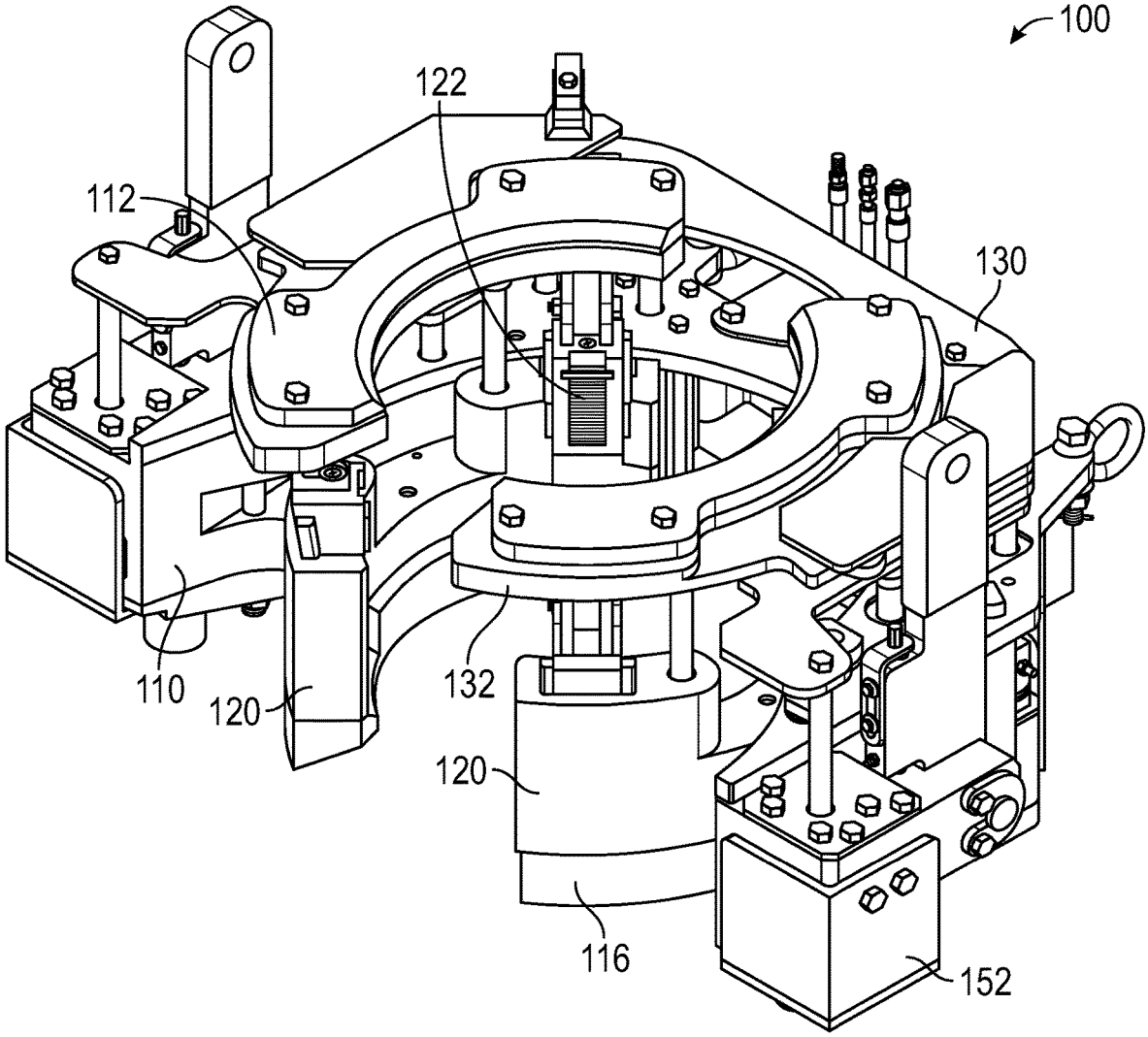
FIG. 2 illustrates another perspective view of the apparatus showing the slip carriers in a closed position and the slips in the up position, according to an embodiment.
Figure 3:
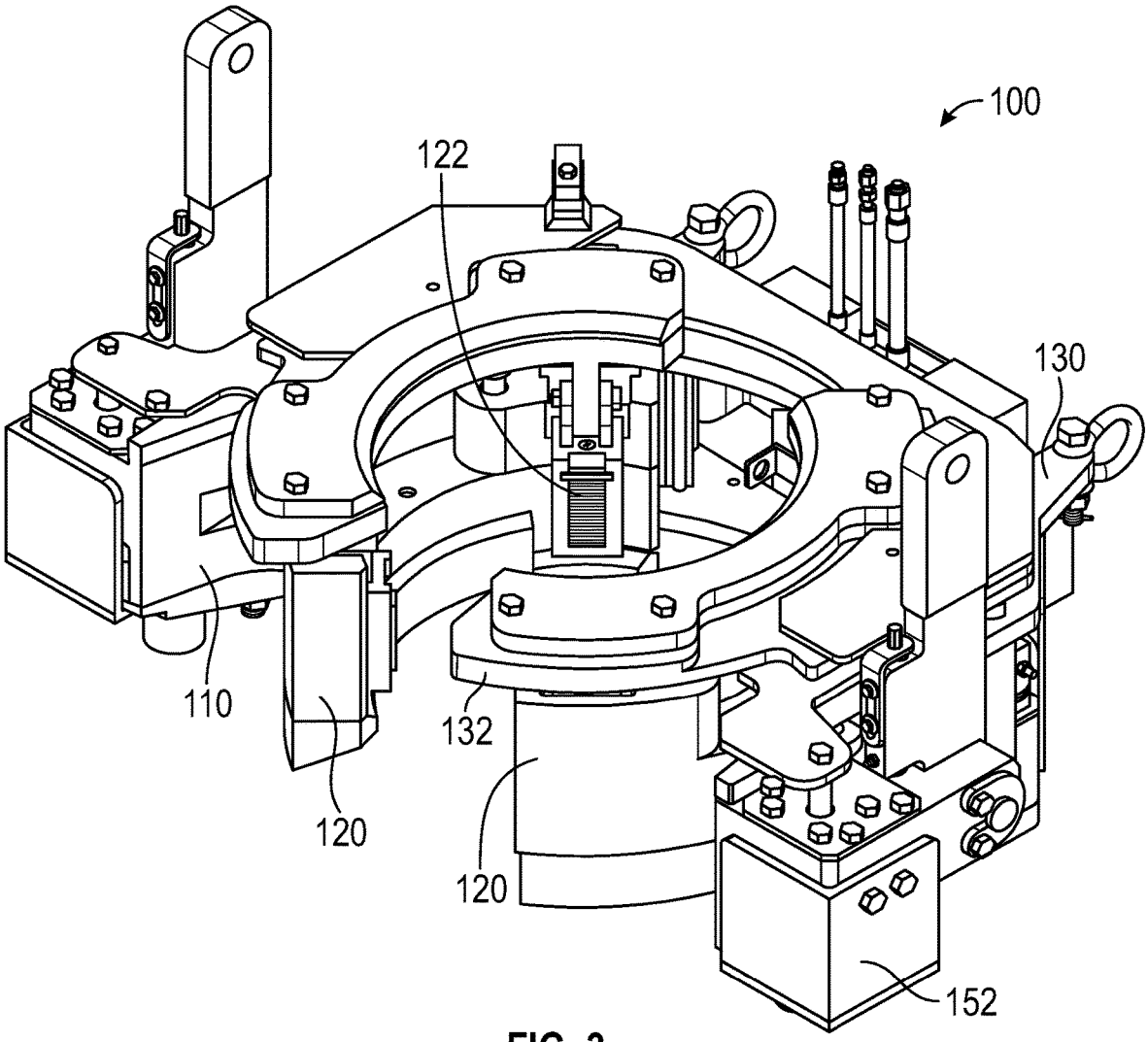
FIG. 3 illustrates another perspective view of the apparatus showing the slip carriers in the closed position and the slips in a down position, according to an embodiment.

FIGS. 1-3 illustrate perspective views of an apparatus 100 for gripping a tubular, according to an embodiment. The apparatus 100 may be or include a horseshoe-type slip elevator. The apparatus 100 may be used to grip and lift tubulars from a substantially horizontal orientation (e.g., when the tubulars are presented at an entrance to the rig floor and/or derrick) to a substantially vertical orientation. The tubulars may be or include segments/joints of casing, liner, drill pipe, completion tubing, or the like. The apparatus 100 may also be used for raising and/or lowering the tubular(s) that are vertically oriented to facilitate joining the tubular(s) into assemblies of two or three tubulars to form a stand. Further, the apparatus 100 may be used to deliver individual tubulars or stands to the well center to facilitate joining the tubular or stand into a full string of tubulars that is lowered into the wellbore.

The apparatus 100 may include a body 110 that is substantially U-shaped (i.e., horseshoe-shaped). The body 110 may have one or more top guides 112 coupled thereto or integral therewith. The top guides 112 may be configured to actuate between a first, open position and a second, closed position. The top guides 112 are shown in the open position in FIG. 1 and in the closed position in FIG. 2. When the top guides 112 are in the open position, a tubular may be inserted laterally into the body 110, such that the apparatus 100 is received at least partially around the tubular. When the top guides 112 are in the closed position, the tubular may not be inserted laterally into or removed laterally from the body 110. The body 110 may also include one or more lift points (two are shown: 114, 115) that may be used to lift the body 110 and any tubulars engaged with the apparatus 100. The lift points 114, 115 may be positioned symmetrically around a centerline through the body 110.

The body 110 may have one or more bottom guides 116 coupled thereto or integral therewith. The bottom guides 116 are shown in the open position in FIG. 1 and in the closed position in FIG. 2. When the bottom guides 116 are in the open position, a tubular may be inserted laterally into the body 110, and when the bottom guides 116 are in the closed position, the tubular may not be inserted laterally into or removed laterally from the body 110. The bottom guides 116 may have a beveled inner diameter to guide the apparatus 100 over the end of the tubular in cases where the apparatus 100 is lowered vertically over the end of the tubular.

The apparatus 100 may also include one or more slip carriers 120. The slip carriers 120 may be or include arcuate segments. The slip carriers 120 may be pivotally coupled to the body 110 and positioned in receptacles that are defined in the body 110. The slip carriers 120 may act as doors that pivot/rotate between a first (e.g., open) position and a second (e.g., closed) position. The slip carriers 120 are shown in the open position in FIG. 1. In the open position, a tubular may be introduced laterally into the body 110 of the apparatus 100. The slip carriers 120 are shown in the closed position in FIGS. 2 and 3. In the closed position, the tubular may not be introduced laterally into or removed laterally from the body 110 of the apparatus 100.

The apparatus 100 may also include one or more slips 122. The slips 122 may be coupled to the slip carriers 120. For example, two slips 122 may be coupled to each slip carrier 120. The slips 122 may be wedge-shaped elements that have one or more gripping elements (e.g., provided on inserts 124 on a front/inner radial surface thereof for engaging and gripping the tubular. A back/outer radial surface of the slips 122 may be configured to mate with and slide along a tapered receptacle of the slip carriers 120. The slips 122 are shown in a first (e.g., up) position in FIGS. 1 and 2. In the up position, the slips 122 are positioned a first radial distance from the centerline through the body 110 such that the slips 122 are not configured to contact a tubular positioned within the apparatus 100. The slips 122 may be retracted underneath the top guides 112 when in the up position. The slips 122 are shown in a second (e.g., down) position in FIG. 3. In the down position, the slips 122 are positioned a second radial distance from the centerline through the body 110 that is less than the first radial distance. In the second position, the slips 122 are configured to contact a tubular positioned within the apparatus 100. Thus, the slips 122 move radially-inward as they move downward and radially-outward as they move upward. The slips 122 may include one or more gripping inserts 124 on the inner radial surfaces thereof. The gripping inserts 124 are configured to contact and grip the tubular. The apparatus 100 may be configured to grip and move tubulars of different sizes by replacing one or more of the components (e.g., top guides 112, slips 122, gripping inserts 124, etc.) with components of a different size.

The apparatus 100 may also include a main timing ring 130, as shown in FIGS. 1-3. The main timing ring 130 may be or include a semi-circular plate that is moved vertically upward and downward. The main timing ring 130 may be moved by one or more pneumatic cylinders 152 that are coupled to the body 110.

The apparatus 100 may also include one or more slip carrier timing rings 132, as shown in FIGS. 1-3. The slip carrier timing rings 132 may be or include arcuate plates that are similar in shape and size to the slip carriers 120. The top guide 112 may be coupled (e.g., bolted) to the top of the slip carrier timing rings 132. The slip carrier timing rings 132 may be coupled to guide rods that allow the slip carrier timing rings 132 to move vertically upward and downward with respect to the slip carriers 120.

The slip carrier timing rings 132 may have an interlocking engagement with the main timing ring 130. When the main timing ring 130 is moved upward or downward, the slip carrier timing rings 132 may move together with the main timing ring 130 due to the interlocking engagement. In addition, the slip carrier timing rings 132 may be coupled to the slips 122 via linkages 134. Thus, as the slip carrier timing rings 132 move upward and downward with respect to the body 110 and the slip carriers 120, the slips 122 may also move upward and downward with respect to the body 110 and the slip carriers 120. The downward movement between the slips 122 and the slip carriers 120 may cause the slips 122 to move radially-inward toward the centerline of the body 110 (e.g., to grip a tubular). Conversely, as the slips 122 move upward, they move radially-outward away from the centerline of the body 110 (e.g., to release the tubular).

The apparatus 100 may also include one or more slip lift cylinders 152 (see FIGS. 1-3). In at least one embodiment, the apparatus 100 may include four slip lift cylinders 152. The slip lift cylinders 152 may be coupled to the body 110. More particularly, the slip lift cylinders 152 may be coupled to opposing sides of the body 110, and adjacent to the lift points 114. The rod ends of each of the slip lift cylinders 152 may be coupled to the main timing ring 130. When the rods of the slip lift cylinders 152 are actuated into the extended position, the main timing ring 130 moves upward together with the slip carrier timing rings 132 and the slips 122. Conversely, when the rods of the slip lift cylinders 152 move downward, the main timing ring 130, the slip carrier timing rings 132, and the slips 122 move downward, to enable the slips 122 to engage the tubular.

Figure 4:
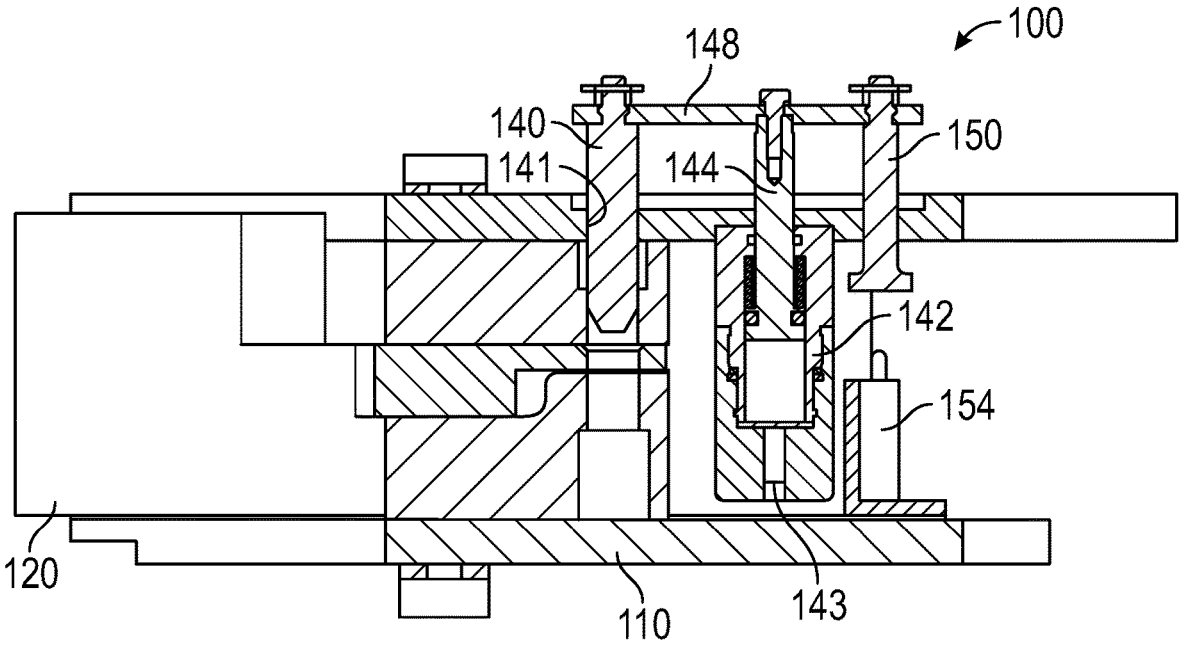
FIG. 4 illustrates a side cross-sectional view of the apparatus showing a slip carrier locking pin assembly with a locking pin in an unlocked (e.g., up) position, according to an embodiment.
Figure 5:
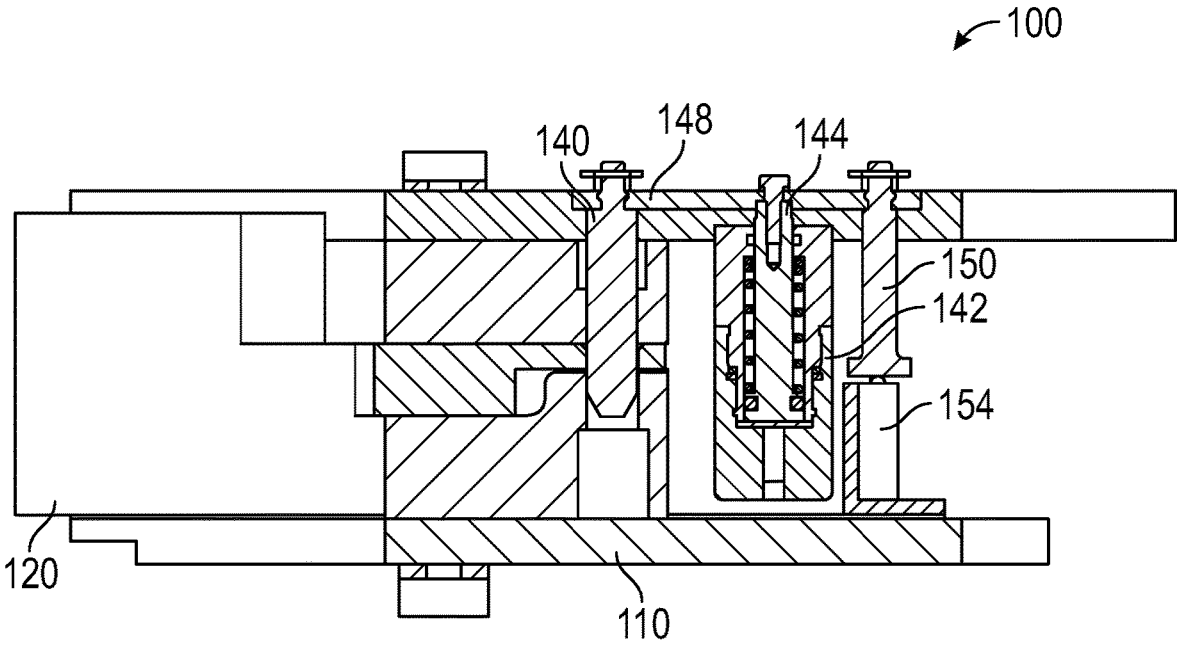
FIG. 5 illustrates a side cross-sectional view of the apparatus showing the slip carrier locking pin assembly with the locking pin in a locked (e.g., down) position, according to an embodiment.

FIG. 4 illustrates a side cross-sectional view of the apparatus 100, showing a slip carrier locking pin assembly with a locking pin 140 in an unlocked (e.g., up) position, and FIG. 5 illustrates a side cross-sectional view of the apparatus 100 showing the slip carrier locking pin assembly with the locking pin 140 in a locked (e.g., down) position, according to an embodiment. The slip carrier locking pin 140 may secure the pivoting slip carriers 120 in the closed position once the apparatus 100 has been placed at least partially around the tubular to be lifted. The slip carrier locking pin 140 may be coupled to a slip carrier locking pin cylinder 142 (described below). The slip carrier locking pin 140 may be received downward through holes 141 in the body 110 and the slip carriers 120 that are vertically-aligned when the slip carriers 120 are in the closed position. When the apparatus 100 is being removed from the tubular, the slip carrier locking pin 140 may be moved upward, which allows the slip carriers 120 to pivot into the open position, thereby creating an opening for the apparatus 100 to be moved laterally-away from the tubular.

The apparatus 100 may also include one or more slip carrier locking pin cylinders 142, as shown in FIGS. 4 and 5. The slip carrier locking pin cylinders 142 may be coupled to the body 110. The slip carrier locking pin cylinders 142 may be a single-acting pneumatic cylinder with an internal coil spring that biases cylinder rods 144 into a retracted position. In other embodiments, the cylinders 142 may be hydraulic, electrical, mechanical, etc. In the illustrated pneumatic embodiment, when pneumatic pressure is applied to the extend port 143 of the slip carrier locking pin cylinders 142, the cylinder rods 144 extend. Each cylinder rod 144 may be coupled to a plate 148 that connects the cylinder rod 144 to one of the slip carrier locking pins 140 and an indicator pin 150. When the cylinder rod 144 is extended, it lifts the slip carrier locking pin 140, thereby releasing the slip carriers 120 from the body 110, allowing the slip carriers 120 to pivot into the open position.

The indicator pin 150 may be secured to the plate 148 that connects to the slip carrier locking pin cylinder 142. As such, the indicator pin 150 may move upward and downward together with the cylinder rod 144 and the slip carrier locking pin 140. When the slip carrier locking pin 140 moves downward into a "lock" position, the indicator pin 150 also moves downward, thereby activating a pneumatic indicator valve that transmits a signal to a control panel indicating that the slip carrier lock pin 140 is in the "lock" position. Alternatively, the indicator may be a hydraulic valve or an electric switch.

A logic circuit may confirm that the slip carrier locking pin 140 is in the "lock" position. The logic circuit may be located in a control panel that is separate and apart from the apparatus 100. The control panel may be where an operator interfaces with the system to send signals to open and close the slips 122. In an embodiment, the logic circuit may be at least partially pneumatic. Once the logic circuit confirms that the slip carrier locking pin 140 is in the "lock" position, a signal (e.g., a pneumatic signal) may be transmitted to the slip lift cylinders 152 (see FIGS. 1-3) that are attached to the body 110, causing the slip lift cylinders 152 to retract moving the main timing ring 130, the slip carrier timing rings 132, and the slips 122 downward, to cause the slips 122 to engage and grip the tubular.

The apparatus 100 may also include one or more slip carrier lock sensing valves 154, as shown in FIGS. 4 and 5. For example, there may be two slip carrier lock sensing valves 154, one for each slip carrier 120 in order to confirm that both slip carriers 120 are closed and locked. The slip carrier lock sensing valves 154 may be coupled to the body 110 such that a central axis of a spool within each slip carrier lock sensing valve is coaxially aligned with the indicator pin 150. The indicator pin 150 may move downward when the slip carrier locking pin cylinder 142 is retracted and the slip carrier locking pin 140 is in the locked (e.g., down) position. The downward movement of the indicator pin 150 depresses a plunger in the slip lock indicator valve 154, which sends a confirming signal to a valve that directs the slip lift cylinders 152 into the down position, thereby setting the slips 122 onto the tubular. The slip carrier lock sensing valve 154 may be in communication with the logic circuit.

Figure 6:
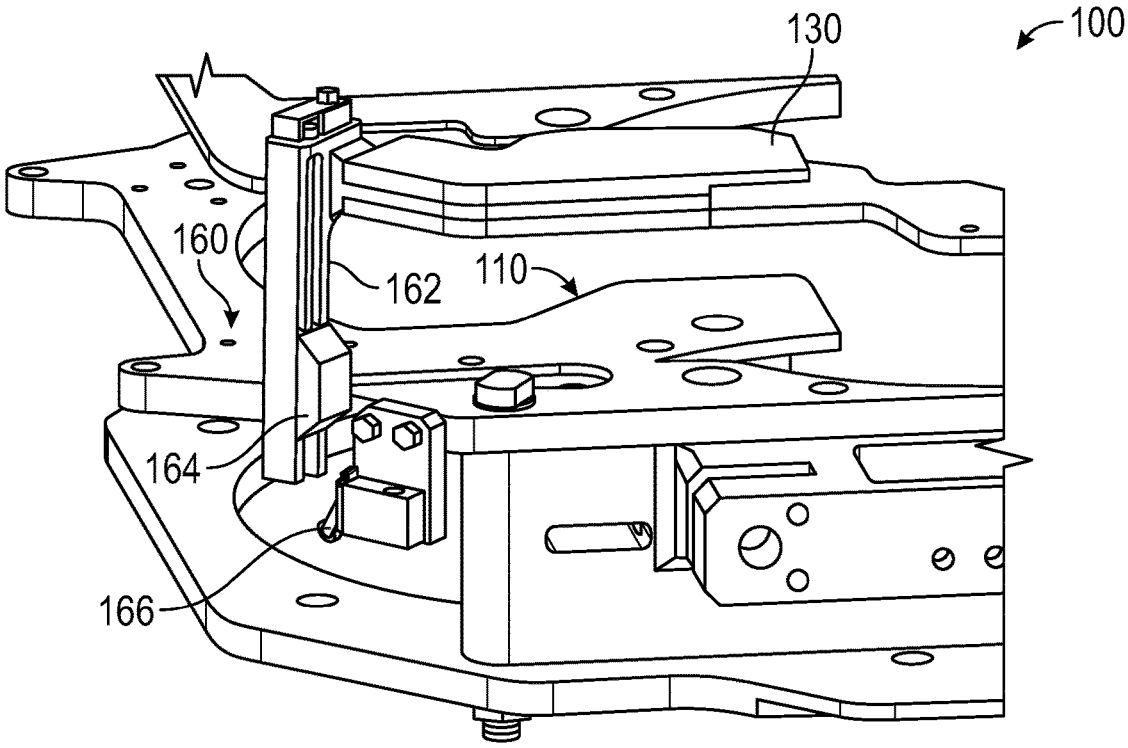
FIG. 6 illustrates a partial perspective view of the apparatus showing a slip position sensing mechanism with slips in an up position, according to an embodiment.

FIG. 6 illustrates a partial perspective view of the apparatus 100 showing a slip position sensing mechanism 160, according to an embodiment. The slip position sensing mechanism 160 may include a slip position indicator rod 162, an indicator ramp 164, and a slip position indicator valve 166. The slip position indicator rod 162 may be coupled to the main timing ring 130 and extend downward therefrom. The indicator ramp 164 may be coupled to, and configured to move with respect to, the slip position indicator rod 162. The slip position indicator valve 166 may be coupled to the body 110. When the main timing ring 130 moves downward to set the slips 122, the slip position indicator rod 162 moves together with the main timing ring 130. Movement of the indicator ramp 164 past the slip position indicator valve 166 activates the valve 166, which transmits a signal to the control panel confirming that the slips 122 are set and indicating that the tubular may be lifted.

Figure 7A:
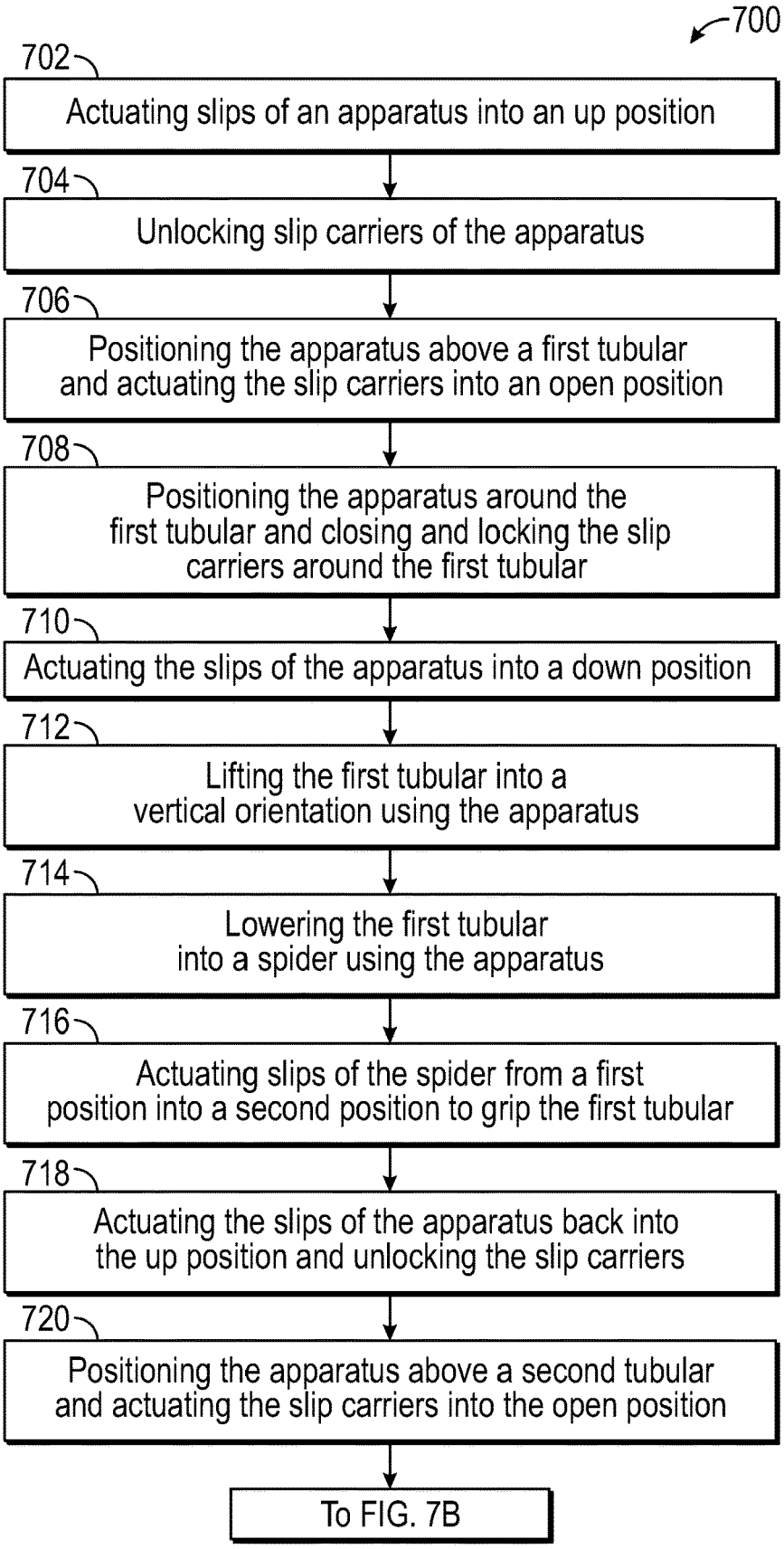
FIGS. 7A-7C illustrate a flowchart of a method for moving one or more tubulars using the apparatus, according to an embodiment.
Figure 7B:
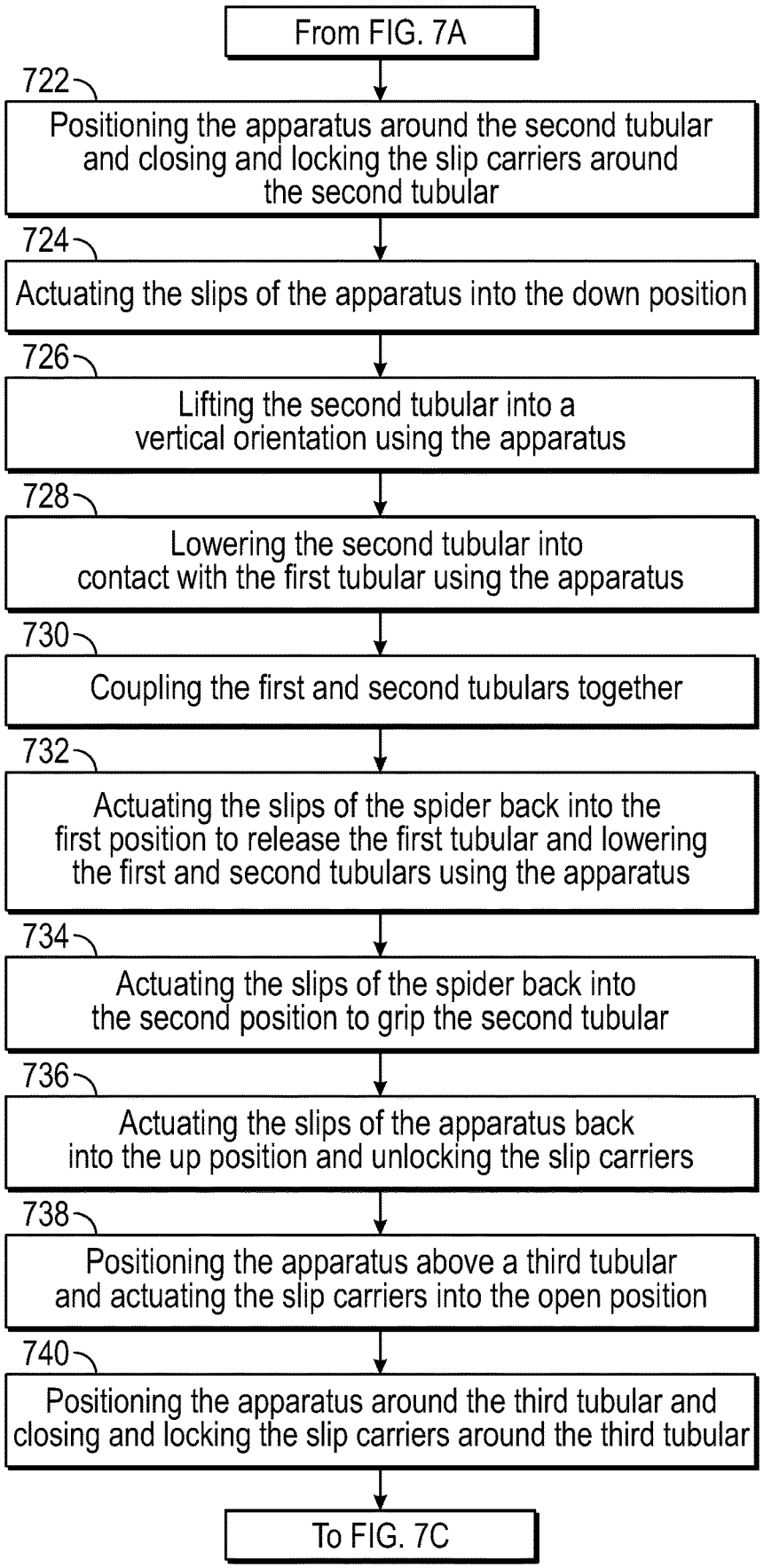
Figure 7C:
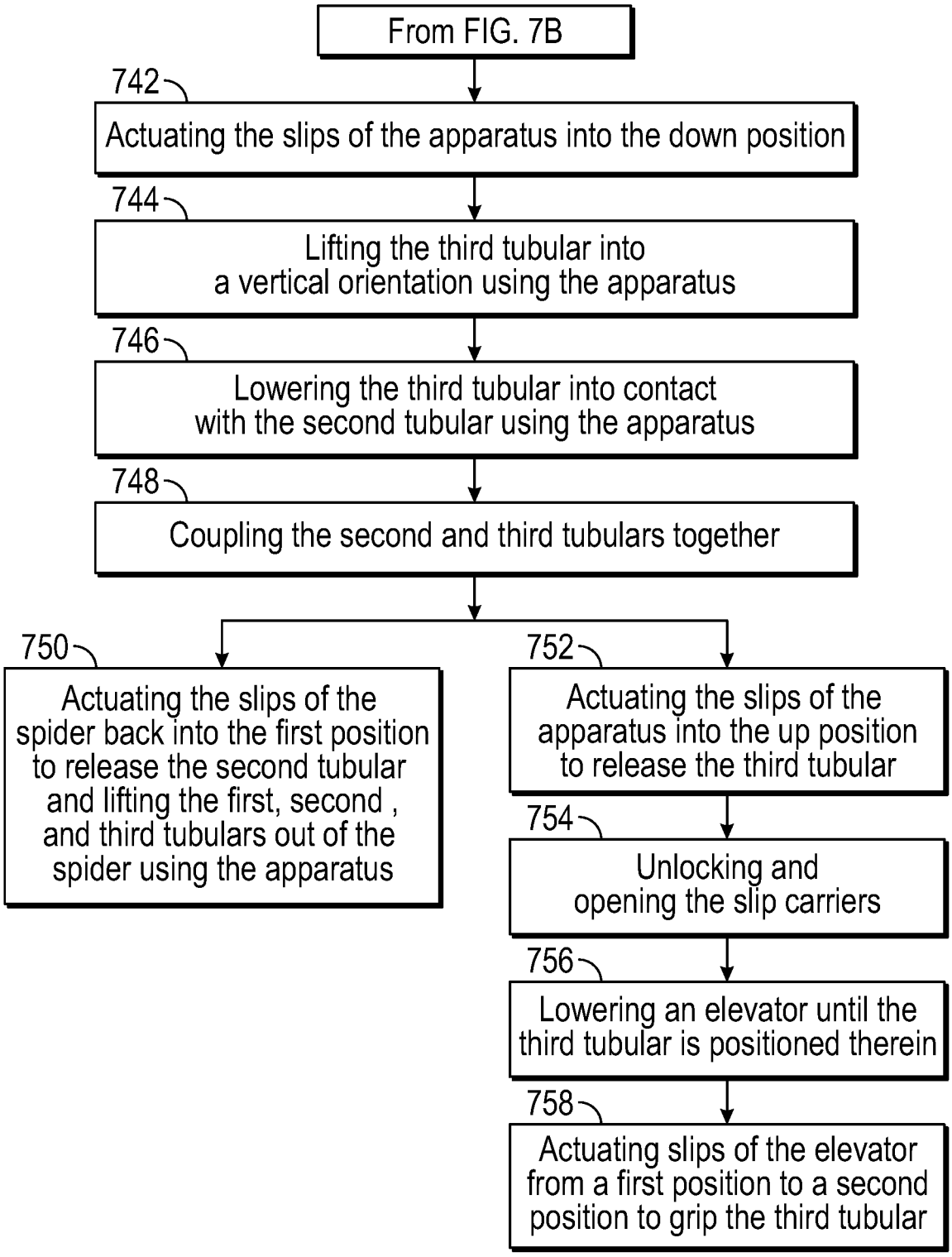
Figure 8:
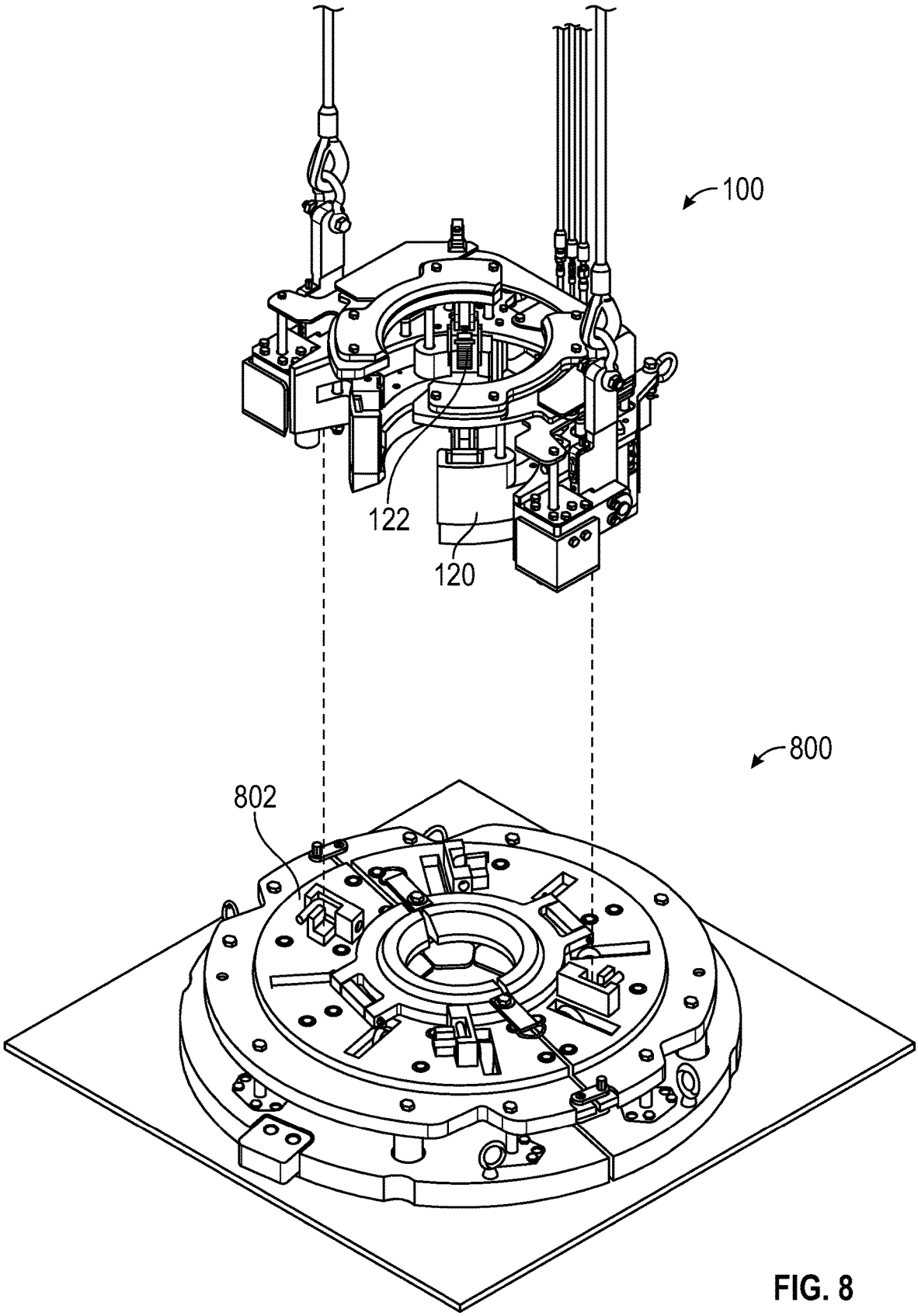
FIG. 8 illustrates an enlarged perspective view of the apparatus aligned with and positioned above well center showing the slips in the up position and the slip carriers in the closed position, according to an embodiment.

FIG. 7 is a flowchart of a method 700 for moving a first tubular 810 using the apparatus 100, according to an embodiment. The method 700 may be viewed together with FIGS. 8-17, which illustrate sequential stages of one embodiment of the method 700. The method 700 may begin with the apparatus 100 suspended above a well center 800. This is shown in FIG. 8. A tubular gripping assembly, such as a spider 802, may be positioned at the well center 800 and below the apparatus 100. The method 700 may include actuating the slips 122 into a first (e.g., up) position, as at 702. The method 700 may also include unlocking the slip carriers 120, as at 704.

Figure 9:
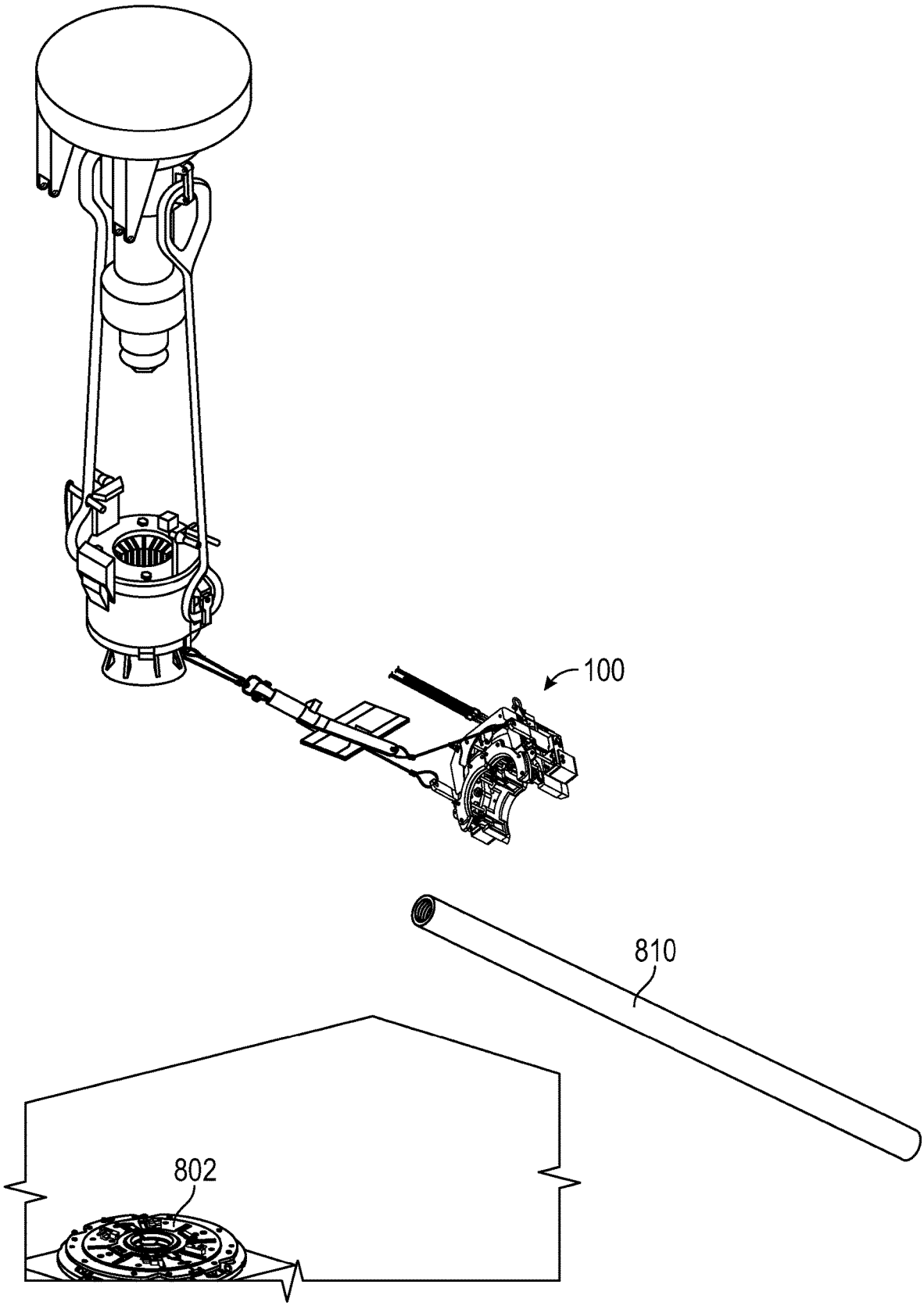
FIG. 9 illustrates a perspective view of the apparatus positioned above a first tubular with the slip carriers in the open position, according to an embodiment.

The method 700 may also include positioning the apparatus 100 above the first tubular 810 and actuating the slip carriers 120 into an open position, as at 706. This is shown in FIG. 9. The first tubular 810 may initially be substantially horizontal. In another embodiment, the first tubular 810 may be positioned in a V-door. Thus, the first tubular 810 may initially be oriented at an angle with respect to the ground. The angle may be from about 10° to about 50° or about 20° to about 40°. Although not shown, in another embodiment, the slip carriers 120 may be closed and locked while being positioned around a tubular 810. In this embodiment, the apparatus 100 may be lowered over the top of a tubular 810 when the tubular 810 is substantially vertical.

Figure 10:
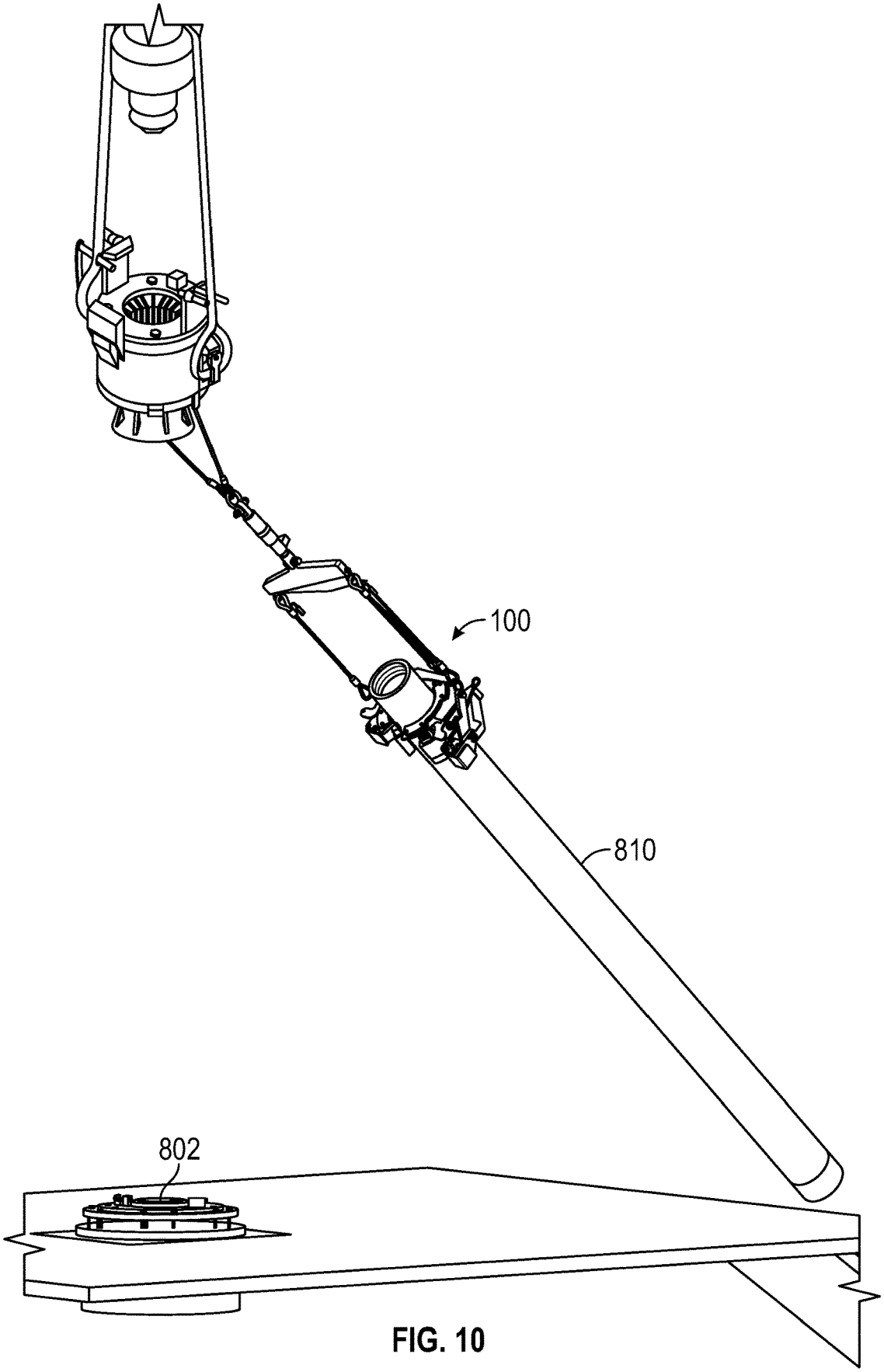
FIG. 10 illustrates a perspective view of the first tubular positioned within the apparatus and the slip carriers in the closed and locked position, according to an embodiment.

The method 700 may also include positioning the apparatus 100 at least partially around the first tubular 810 and closing and locking the slip carriers 120 around the first tubular 810, as at 708. This is shown in FIG. 10. The slip carriers 120 may be in the open position and pointing downward over the first tubular 810 as the apparatus 100 is lowered. As the apparatus 100 is positioned at least partially around the first tubular 810, the contact between the first tubular 810 and the slip carriers 120 may cause the slip carriers 120 to rotate into the closed and locked position without any manual intervention or powered actuators being required to close the slip carriers 120. More particularly, the shape of the slip carriers 120 and the location of the pivot pin allow the first tubular 810 to rotate the slip carriers 120 as the first tubular 810 moves into the throat of the apparatus 100. The slips 122 may be spaced radially-apart from the first tubular 810 when the slip carriers 120 are closed and locked and the slips 122 are in the first position.

The method 700 may also include actuating the slips 122 into a second (e.g., down) position, as at 710. The second position of the slips 122 may be downward and radially-inward with respect to the first position. Thus, the slips 122 may contact and grip the first tubular 810 when in the second position.

Figure 11:
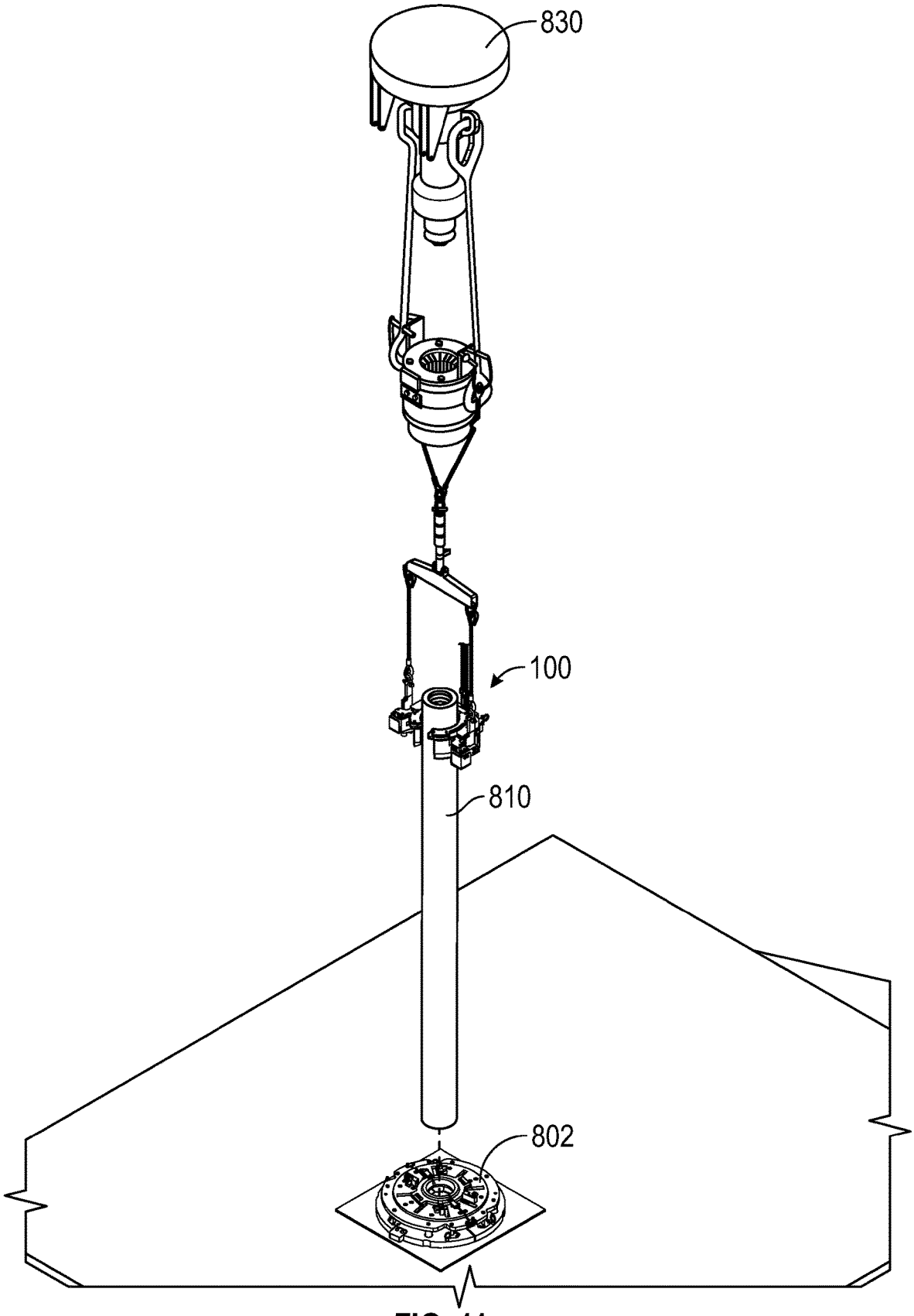
FIG. 11 illustrates a perspective view of the apparatus suspending the first tubular in the vertical orientation over the well center, according to an embodiment.

The method 700 may also include lifting the first tubular 810 into a substantially vertical orientation using a top drive 830 while the first tubular 810 is gripped by the apparatus 100, as at 712. This is shown in FIG. 11. In the substantially vertical orientation, the first tubular 810 may be positioned above and aligned with the well center 800 (e.g., the spider 802).

Figure 12:
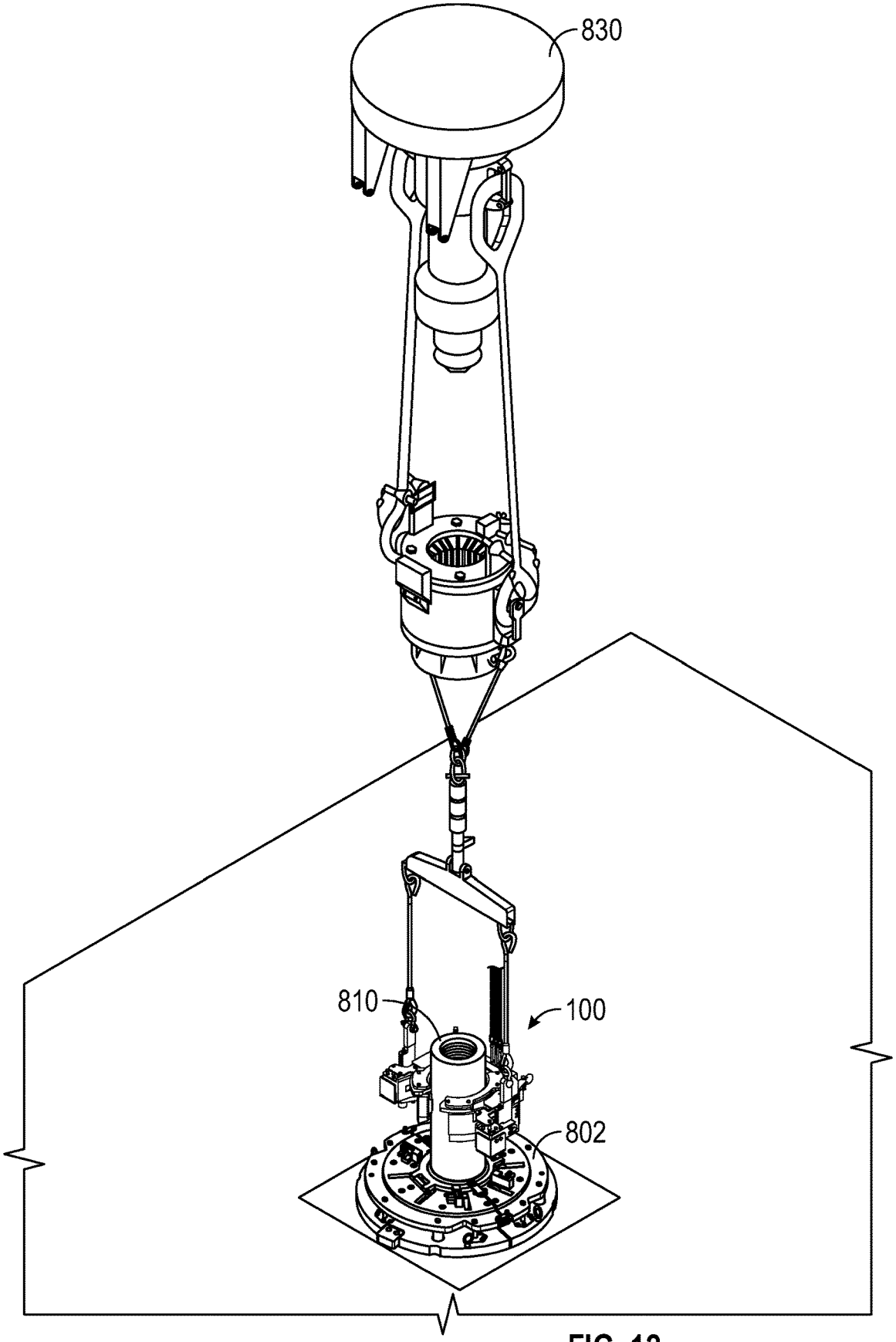
FIG. 12 illustrates a perspective view of the apparatus lowering the first tubular into a spider, according to an embodiment.
Figure 13:
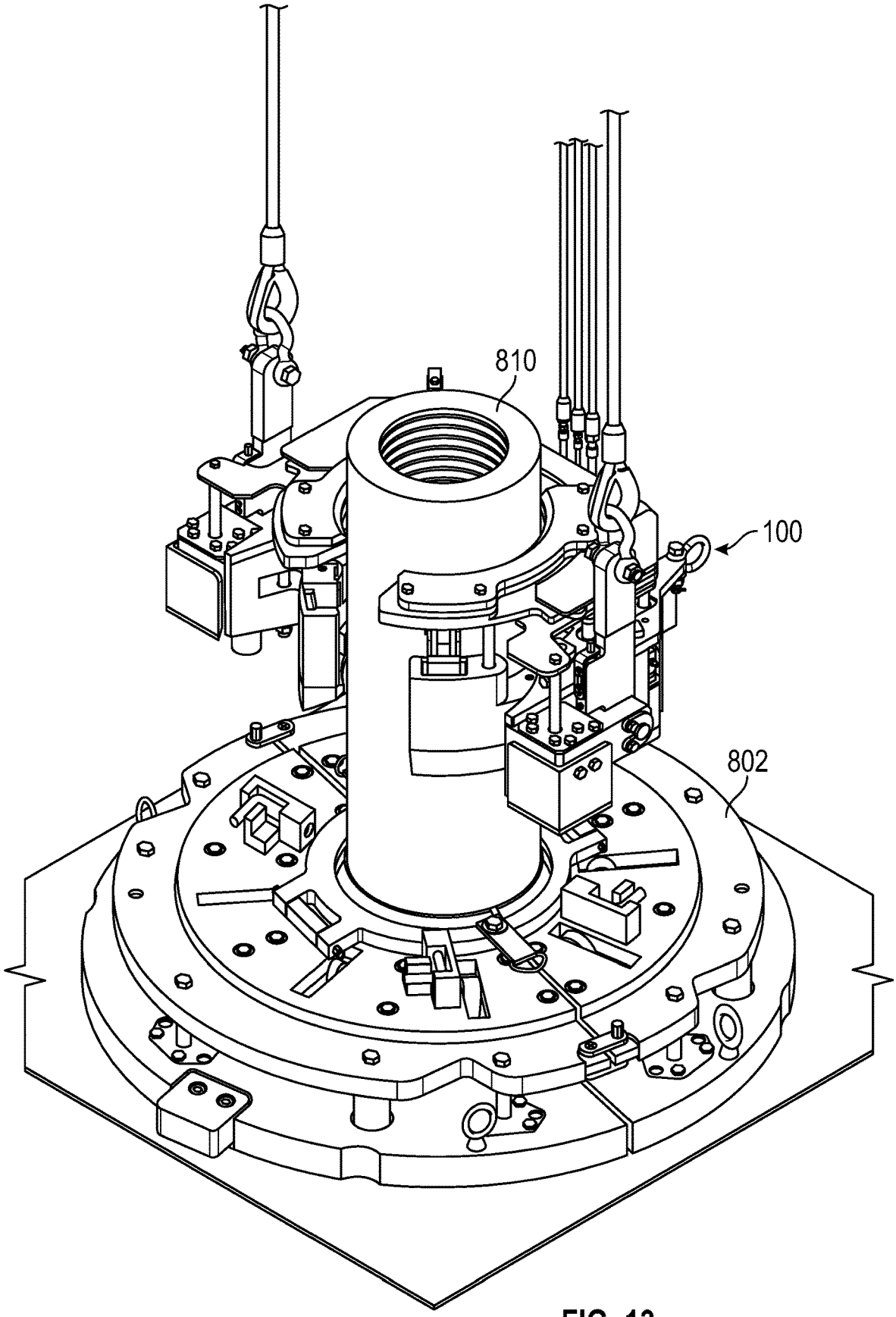
FIG. 13 illustrates a perspective view of the slips of the spider engaging and gripping the first tubular and the slips of the apparatus releasing the first tubular, according to an embodiment.

The method 700 may also include lowering (e.g., stabbing) the first tubular 810 into the spider 802 using the top drive 830, as at 714. This is shown in FIG. 12. The method 700 may also include actuating one or more slips of the spider 802 from a first position to a second position to grip and engage the first tubular 810, as at 716. This is shown in FIG. 13. The method 700 may also include actuating the slips 122 of the apparatus 100 back into the first position and unlocking the slip carriers 120, as at 718.

Figure 14:
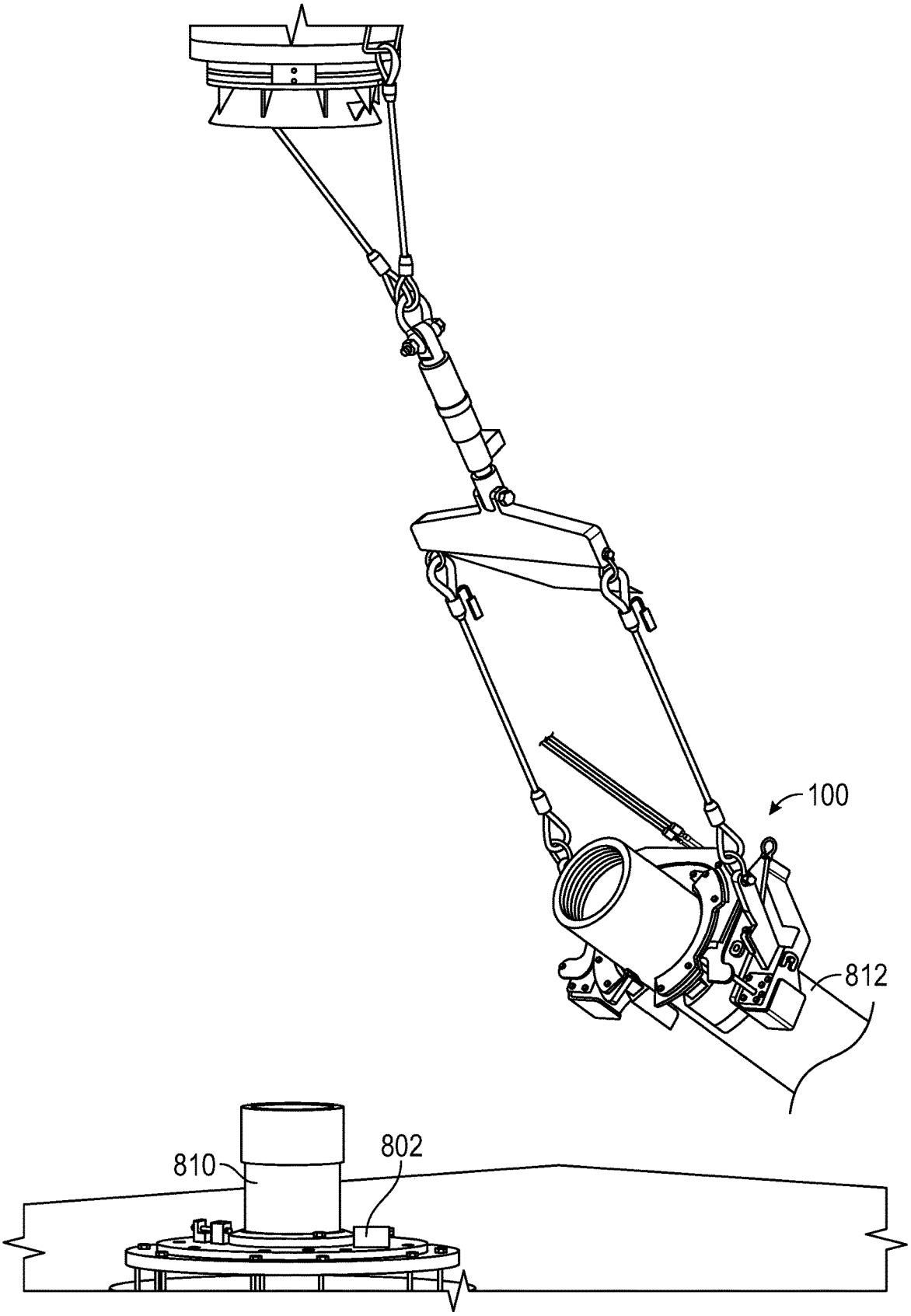
FIG. 14 illustrates a perspective view of the second tubular positioned within the apparatus and the slip carriers in the closed and locked position, according to an embodiment.

The method 700 may also include positioning the apparatus 100 above a second tubular 812 and actuating the slip carriers 120 into the open position, as at 720. The second tubular 812 may be positioned in the V-door. The method 700 may also include positioning the apparatus 100 at least partially around the second tubular 812 and closing and locking the slip carriers 120 around the second tubular 812, as at 722. This is shown in FIG. 14. The method 700 may also include actuating the slips 122 into the second position, as at 724.

Figure 15:
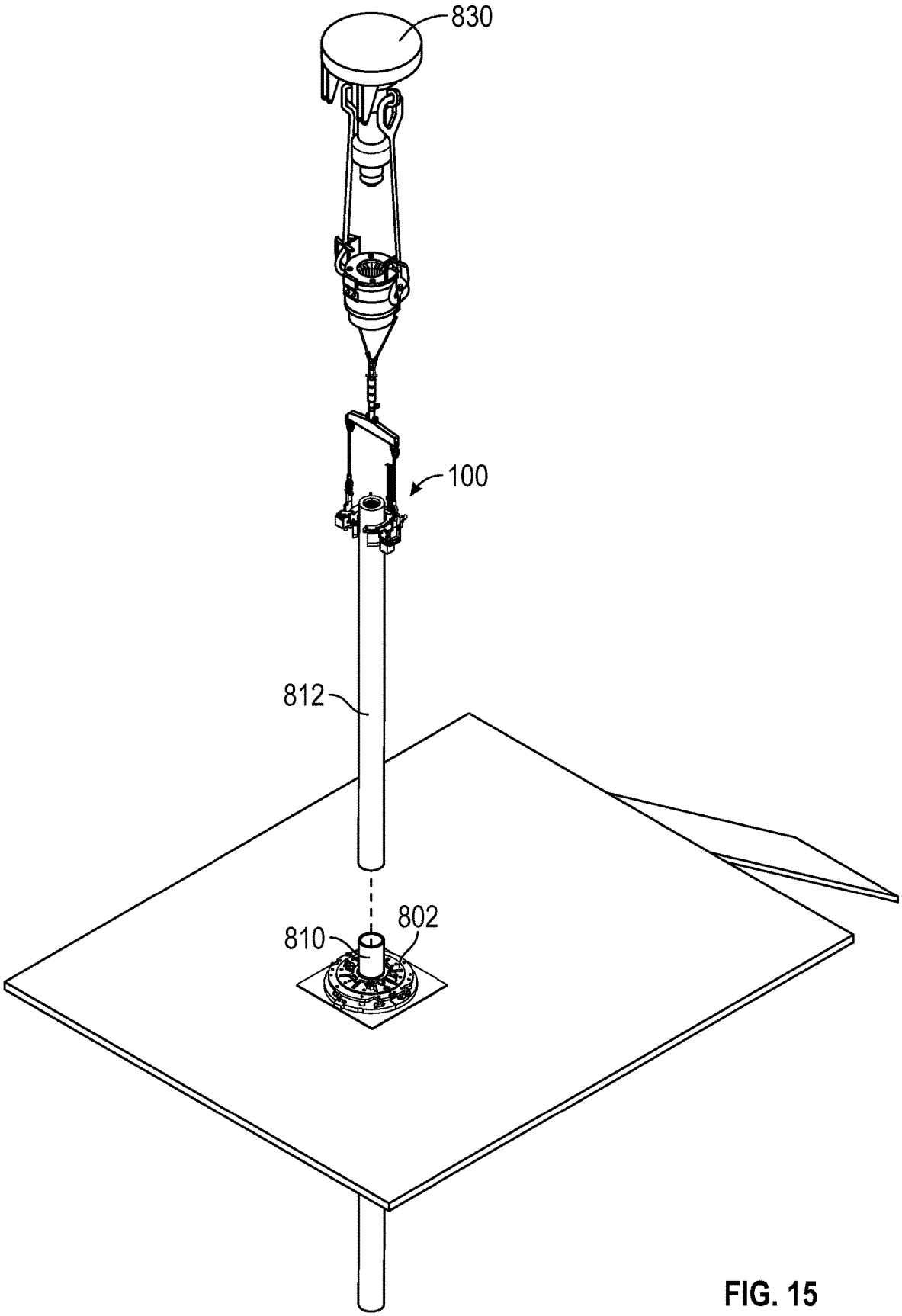
FIG. 15 illustrates a perspective view of the apparatus suspending the second tubular in the vertical orientation over the well center, according to an embodiment.

The method 700 may also include lifting the second tubular 812 into a substantially vertical orientation using the top drive 830 while the second tubular 812 is gripped by the apparatus 100, as at 726. This is shown in FIG. 15. In the substantially vertical orientation, the second tubular 812 may be positioned above and aligned with the well center 800 (e.g., the spider 802). The method 700 may also include lowering the second tubular 812 into contact with the first tubular 810 using the top drive 830, as at 728. More particularly, a pin connection at the lower end of the second tubular 812 may be lowered into a box connection at the upper end of the first tubular 810.

The method 700 may also include coupling (e.g., making up) the first and second tubulars 810, 812, as at 730. The first tubular 810 may be gripped and supported by the spider 802 when the first and second tubulars 810, 812 are coupled together, and the second tubular 812 may be gripped and supported by the apparatus 100 when the first and second tubulars 810, 812 are coupled together. The method 700 may also include actuating the slips of the spider 802 back into the first position (e.g., to release the second tubular 812) and lowering the first and second tubulars 810, 812 using the top drive 830, as at 732. The method 700 may also include actuating the slips of the spider 802 back into the second position to grip the second tubular 812, as at 734. The method 700 may also include actuating the slips 122 of the apparatus 100 back into the first position and unlocking the slip carriers 120, as at 736.

The method 700 may also include positioning the apparatus 100 above a third tubular 814 and actuating the slip carriers 120 into the open position, as at 738. The third tubular 814 may be positioned in the V-door. The method 700 may also include positioning the apparatus 100 at least partially around the third tubular 814 and closing and locking the slip carriers 120 around the third tubular 814, as at 740. The method 700 may also include actuating the slips 122 into the second position, as at 742.

The method 700 may also include lifting the third tubular 814 into a substantially vertical orientation using the top drive 830 while the third tubular 814 is gripped by the apparatus 100, as at 744. In the substantially vertical orientation, the third tubular 814 may be positioned above and aligned with the well center 800 (e.g., the spider 802). The method 700 may also include lowering the third tubular 814 into contact with the second tubular 812 using the top drive 830, as at 746. More particularly, a pin connection at the lower end of the third tubular 814 may be lowered into a box connection at the upper end of the second tubular 812.

Figure 16:
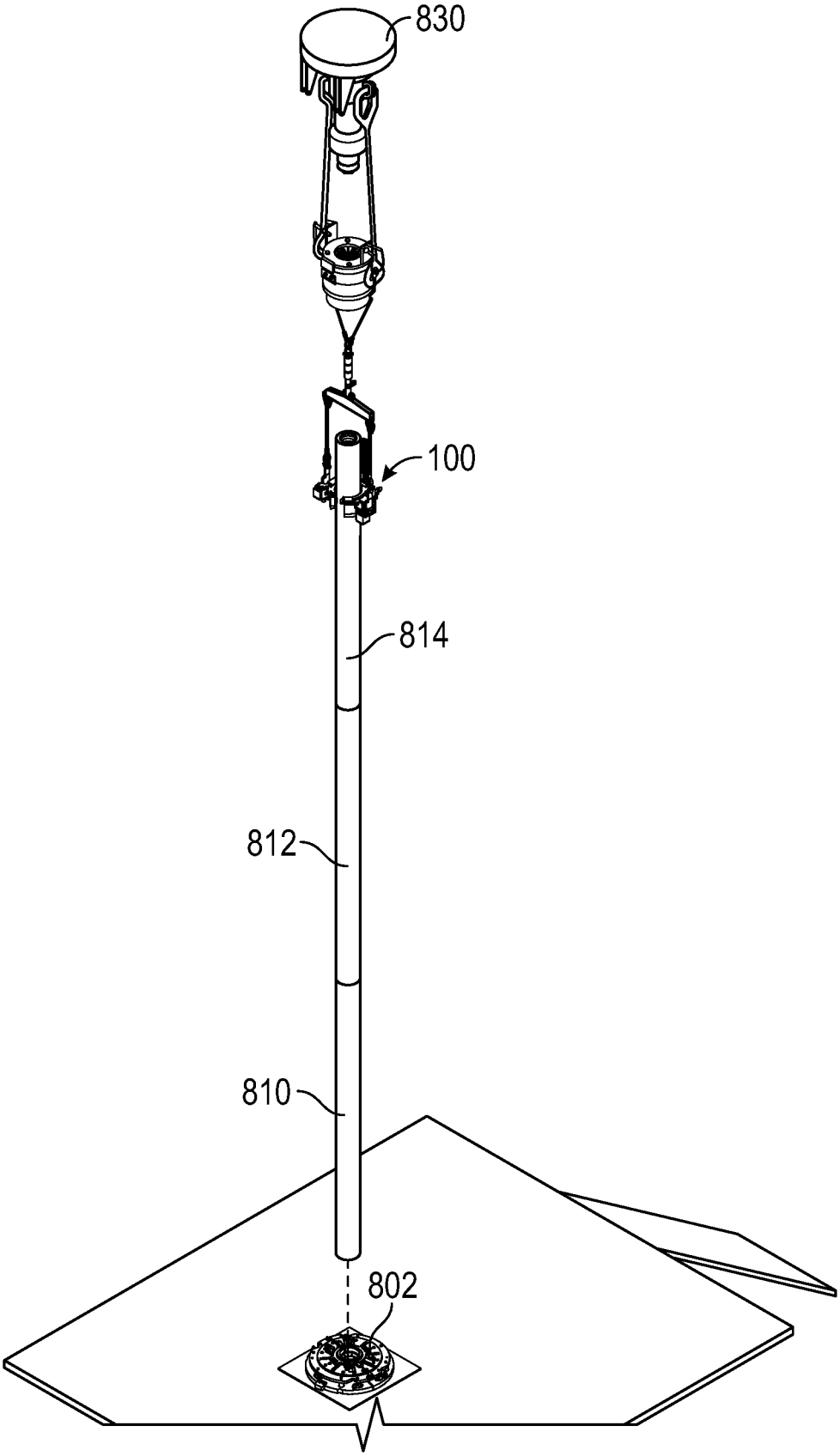
FIG. 16 illustrates a perspective view of the apparatus lifting the first, second, and third tubulars up and out of the spider, according to an embodiment.

The method 700 may also include coupling (e.g., making up) the second and third tubulars 812, 814, as at 748. The second tubular 812 may be gripped and supported by the spider 802 when the second and third tubulars 812, 814 are coupled together, and the third tubular 814 may be gripped and supported by the apparatus 100 when the second and third tubulars 812, 814 are coupled together. The method 700 may also include actuating the slips of the spider 802 back into the first position (e.g., to release the second tubular 812) and lifting the first, second, and third tubulars 810, 812, 814 (i.e., a stand) out of the spider 802 using the top drive 830 while the third tubular 814 is gripped by the apparatus 100, as at 750. This is shown in FIG. 16.

Figure 17:
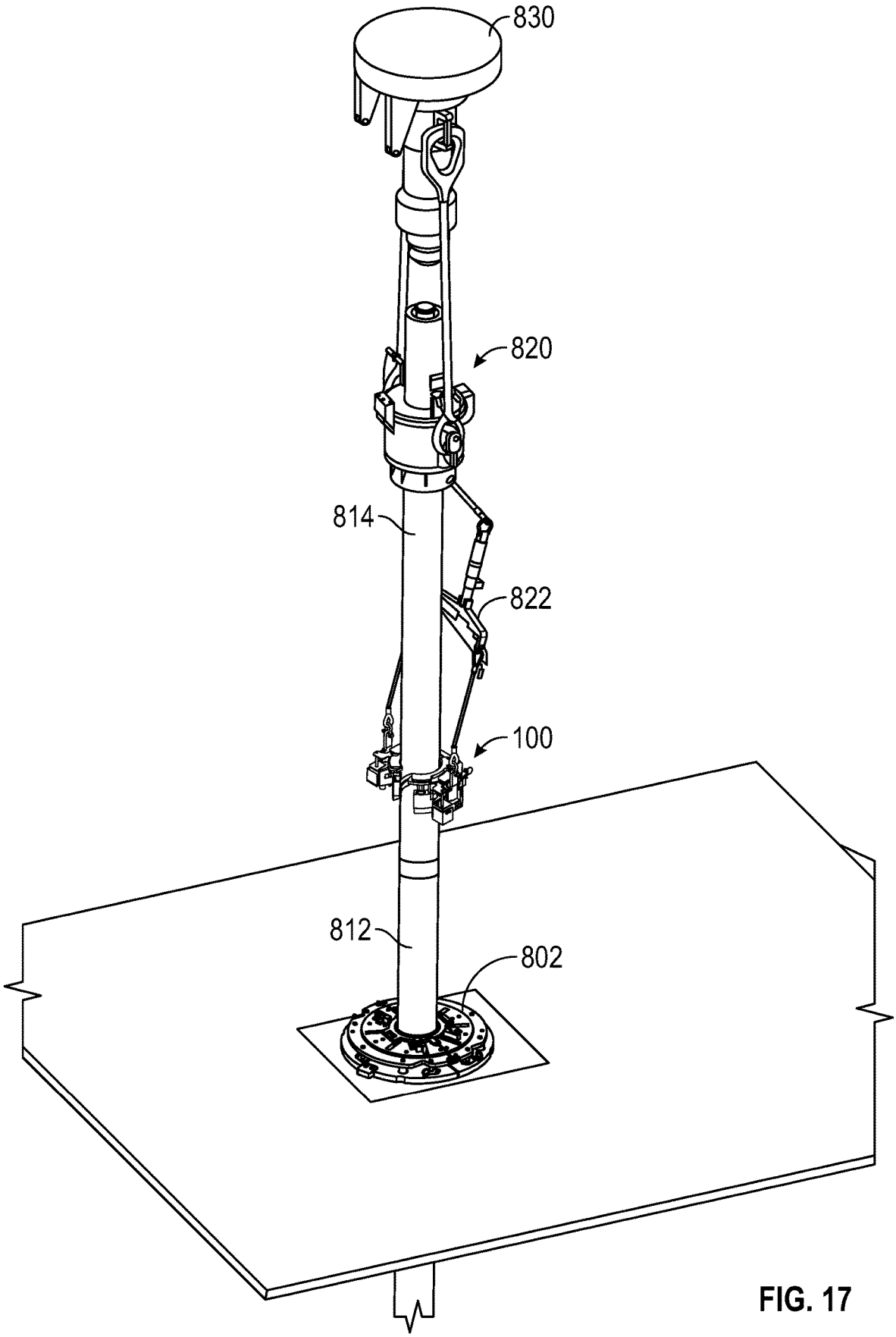
FIG. 17 illustrates the apparatus and an elevator being lowered such that the elevator is positioned around and grips the third tubular, according to an embodiment.

In an alternative embodiment, after the second and third tubulars 812, 814 are coupled together, the method 700 may include actuating the slips 122 of the apparatus 100 back into the first position to release the third tubular 814, as at 752. The method 700 may also include unlocking and opening the slip carriers 120, as at 754. The method 700 may also include lowering an elevator 820 until the third tubular 814 is positioned at least partially therein using the top drive 830, as at 756. This is shown in FIG. 17. The elevator 820 may be positioned above the apparatus 100 and coupled thereto by one or more linkages 822. Thus, the apparatus 100 and the elevator 820 may be lowered together until the third tubular 814 is positioned at least partially within the elevator 820. The method 700 may also include actuating slips of the elevator 820 from a first position into a second position to grip the third tubular 814, as at 758.

Figure 18:
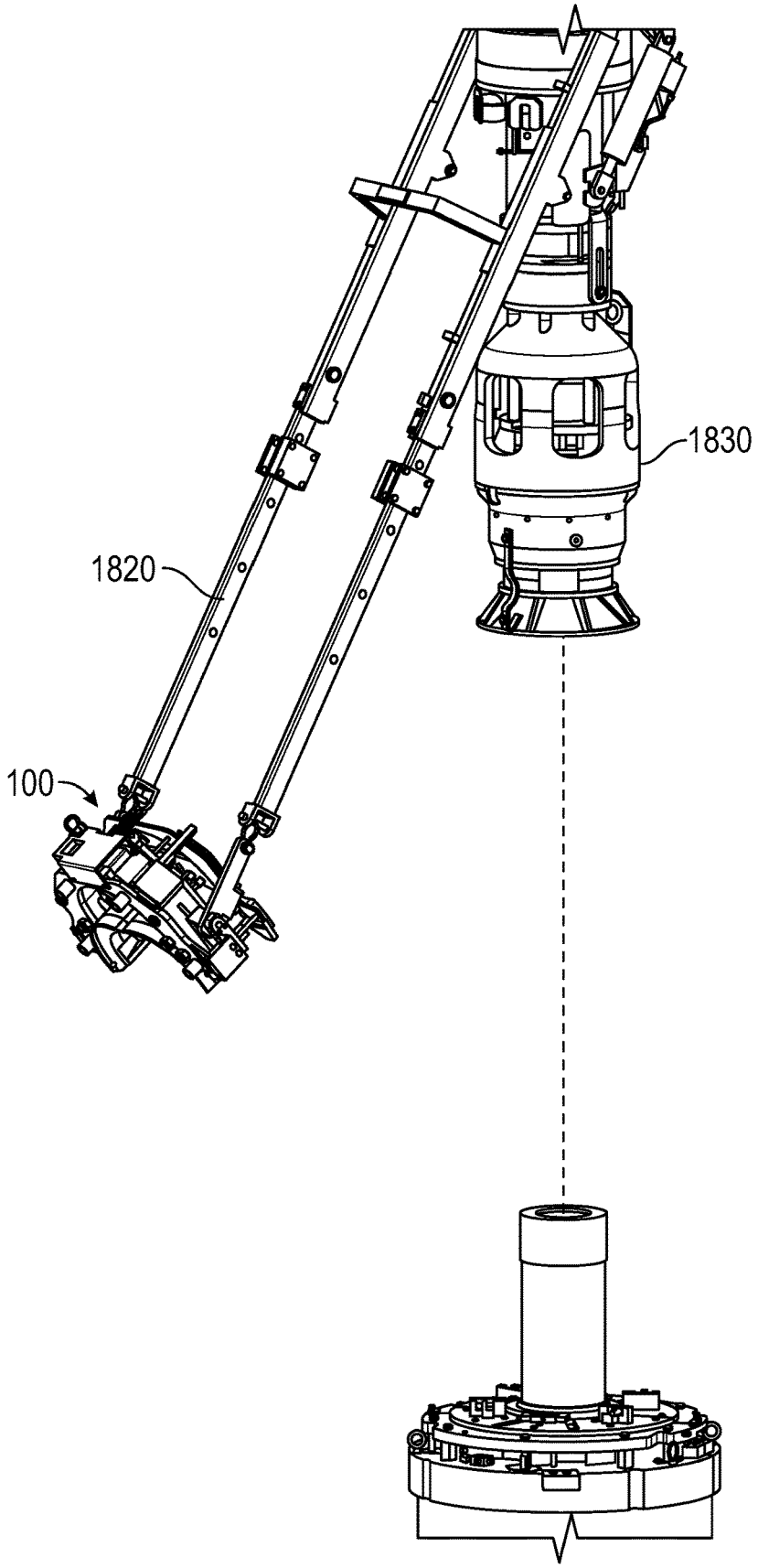
FIG. 18 illustrates a pair of arms coupled to and positioned between the apparatus and a casing running tool, according to an embodiment.
Figure 20:
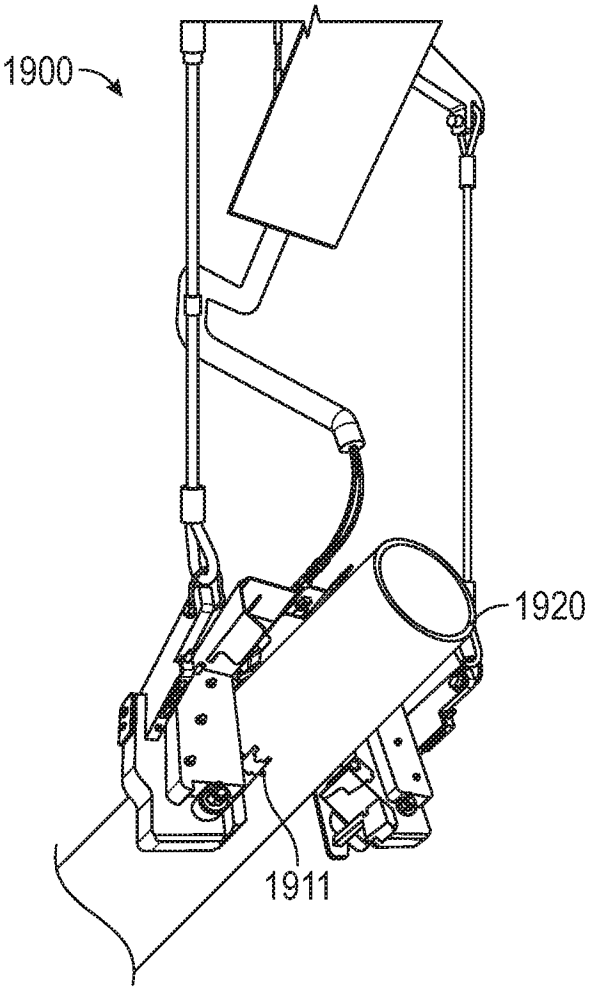
FIG. 20 (Prior Art)
FIG. 20 illustrates a perspective view of the apparatus shown in FIG. 19 gripping a tubular, according to an embodiment.
Figure 19:
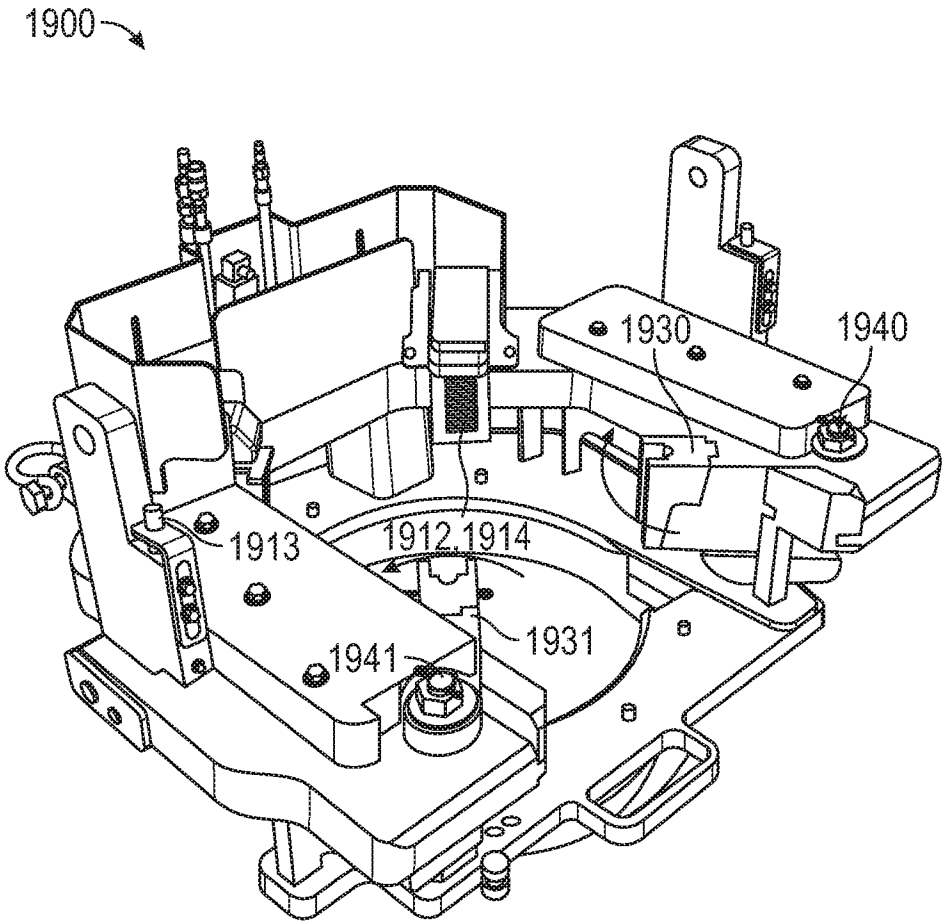
FIG. 19 (Prior Art)
FIG. 19 illustrates a perspective view of a prior art apparatus, according to an embodiment.

The apparatus 100 may also be used on pipe pick-up arms, such as on a casing running tool ("CRT"). The specific rig type and application may determine whether a CRT is used or a conventional elevator is used, and the rig-up of the apparatus 100 may be determined by this selection. FIG. 18 illustrates a CRT application of the apparatus 100. The arms 1820 may tilt/luff out to move the apparatus 100 toward a tubular. The CRT 1830 may then be lowered to position the apparatus 100 at least partially around the tubular while the arms 1820 are tilted/luffed out. The arms 1820 may then be moved/tilted back in to cause the tubular to take a substantially vertical orientation. The CRT 1830 may then be lowered onto the tubular.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

While the present teachings have been illustrated with respect to one or more implementations, alterations and/or modifications may be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment. Finally, "exemplary" indicates the description is used as an example, rather than implying that it is an ideal.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. An apparatus for gripping a tubular, comprising:

a substantially U-shaped body;

a slip carrier coupled to an inner surface of the body, wherein the slip carrier is configured to pivot with respect to the body between an open position and a closed position, and wherein, when the slip carrier is in the open position, the slip carrier creates an opening to allow a tubular to be introduced laterally into the body; and a slip coupled to the slip carrier, wherein the slip is configured to move radially between a first position in which the slip is spaced apart from the tubular and a second position in which the slip contacts and grips the tubular a main timing ring;

a cylinder that is coupled to the body that moves the main timing ring up and down;

a slip position indicator rod configured to move downward together with the main timing ring;

an indicator ramp coupled to and configured to move together with the slip position indicator rod; and a slip position indicator valve coupled to the body, wherein movement of the indicator ramp past the slip position indicator valve causes a signal to be transmitted indicating that the slip is in the second position.

2. The apparatus of claim 1, wherein the tubular being introduced laterally into the body causes the slip carrier to pivot into the closed position, and wherein the slip carrier pivots into the closed position without manual intervention or powered actuators.

3. The apparatus of claim 1, further comprising a top guide coupled to the body, wherein the slip is retracted radially and vertically to a position that is at least partially underneath the top guide when in the first position.

4. The apparatus of claim 3, wherein the slip has one or more gripping inserts coupled thereto, and wherein the apparatus is configured to grip and move another tubular having a different diameter by replacing the slip, the top guide, or the gripping insert with another slip, another top guide, or another gripping insert having a different size.

5. The apparatus of claim 1, further comprising a slip carrier lock that is configured to secure the slip carrier in the closed position when the slip carrier is rotated into the closed position with respect to the body.

6. The apparatus of claim 5, wherein the slip carrier lock comprises a slip carrier locking pin that is configured to secure the slip carrier in the closed position, wherein the slip carrier locking pin is configured to move through a first hole formed through the body and a second hole formed through the slip carrier, and wherein the first and second holes are aligned when the slip carrier is in the closed position.

7. The apparatus of claim 6, further comprising:

a slip carrier locking pin cylinder that is coupled to the body; and a cylinder rod, wherein the slip carrier locking pin cylinder includes a pneumatic or mechanical spring that biases the cylinder rod into a retracted position, and wherein the cylinder rod actuates into an extended position when pressure is applied to the slip carrier locking pin cylinder.

8. The apparatus of claim 7, wherein, as the cylinder rod actuates into the extended position, the cylinder rod lifts the slip carrier locking pin, thereby allowing the slip carrier to pivot into the open position.

9. The apparatus of claim 8, further comprising an indicator pin coupled to the cylinder rod, wherein the indicator pin is configured to move axially upward and downward together with the cylinder rod and the slip carrier locking pin, and wherein the indicator pin is configured to activate a hydraulic valve, electric switch, or electric sensor that transmits a first signal to a control panel, the first signal representing that the slip carrier locking pin cylinder is in a locked position, when activated by the indicator pin.

10. The apparatus of claim 9, wherein a second signal is transmitted from the control panel in response to the first signal, the second signal causing the slip to actuate into the second position.

11. The apparatus of claim 1, wherein the slip position indicator valve comprises a hydraulic valve, a pneumatic valve, an electric switch, or an electric sensor.

12. An apparatus for gripping a tubular, comprising:

a U-shaped body;

a slip carrier coupled to an inner surface of the body, wherein the slip carrier is configured to pivot with respect to the body between an open position and a closed position, wherein a tubular is configured to be introduced laterally into the body when the slip carrier is in the open position, and wherein the tubular being introduced laterally into the body causes the slip carrier to pivot into the closed position;

a slip carrier locking pin configured to secure the slip carrier in the closed position, wherein the slip carrier locking pin is configured to move through a first hole formed through the body and a second hole formed through the slip carrier, and wherein the first and second holes are aligned when the slip carrier is in the closed position;

a slip coupled to the slip carrier, wherein the slip is configured to move radially between a first position in which the slip is spaced apart from the tubular and a second position in which the slip contacts and grips the tubular;

a main timing ring;

a pneumatic cylinder coupled to the body that moves the main timing ring up and down;

a slip position indicator rod configured to move downward together with the main timing ring;

an indicator ramp coupled to and configured to move together with the slip position indicator rod; and a slip position indicator valve coupled to the body, wherein movement of the indicator ramp past the slip position indicator valve causes a signal to be transmitted indicating that the slip is in the second position.

13. The apparatus of claim 12, wherein the slip is configured to move radially and vertically between the first position and the second position.

14. A method for moving one or more tubulars, comprising:

positioning a slip carrier of an apparatus at least partially around a first tubular;

pivoting the slip carrier into a closed and locked position, wherein the slip carrier is pivoted with respect to a body of the apparatus, wherein pivoting the slip carrier into the closed and locked position prevents the first tubular from being removed laterally from the apparatus;

actuating a slip that is coupled to the slip carrier from a first position into a second position to grip the first tubular;

lifting the first tubular into a substantially vertical orientation using a top drive that is coupled to the apparatus while the first tubular is gripped by the slip, actuating the slip back into the first position to release the first tubular; and lowering a casing running tool into contact with the first tubular while the first tubular is positioned within the slip carrier, which is in the closed and locked position.

15. The method of claim 14, wherein the slip carrier pivots into the closed and locked position without manual intervention or powered actuators.

16. The method of claim 14, wherein positioning the slip carrier comprises laterally receiving the first tubular into a U-shaped body of the apparatus, the slip carrier being coupled to the U-shaped body.

17. A method for moving one or more tubulars, comprising:

positioning a U-shaped body and a slip carrier of an apparatus at least partially around a first tubular, wherein the U-shaped body has two substantially parallel sections and a curved section therebetween;

pivoting the slip carrier with respect to the U-shaped body into a closed and locked position, wherein pivoting the slip carrier into the closed and locked position prevents the first tubular from being removed laterally from the apparatus;

actuating a slip that is coupled to the slip carrier from a first position into a second position to grip the first tubular;

lifting the first tubular into a substantially vertical orientation using a top drive that is coupled to the apparatus while the first tubular is gripped by the slip;

lowering the first tubular into a tubular gripping assembly using the top drive while the first tubular is gripped by the slip;

gripping the first tubular with the tubular gripping assembly;

actuating the slip into the first position to release the first tubular; and actuating the slip carrier into an open position positioning the apparatus at least partially around a second tubular, which causes the slip carrier of the apparatus to pivot from the open position to the closed and locked position, preventing the second tubular from being removed laterally from the apparatus;

actuating the slip from the first position into the second position to grip the second tubular;

lifting the second tubular into a substantially vertical orientation using the top drive while the second tubular is gripped by the slip;

lowering the second tubular into contact with the first tubular using the top drive while the second tubular is gripped by the slip;

coupling the first and second tubulars together;

releasing the first tubular from the tubular gripping assembly;

lowering the first and second tubulars until the second tubular is positioned within the tubular gripping assembly;

gripping the second tubular with the tubular gripping assembly;

actuating the slip back into the first position to release the second tubular; and actuating the slip carrier into the open position.

18. The method of claim 17, further comprising:

positioning the apparatus at least partially around a third tubular, which causes the slip carrier of the apparatus to pivot from the open position to the closed and locked position, thereby preventing the third tubular from being removed laterally from the apparatus;

actuating the slip from the first position into the second position to grip the third tubular;

lifting the third tubular into a substantially vertical orientation using the top drive while the third tubular is gripped by the slip;

lowering the third tubular into contact with the second tubular using the top drive while the third tubular is gripped by the slip; and coupling the second and third tubulars together.

19. The method of claim 18, further comprising:

releasing the second tubular from the tubular gripping assembly; and raising the first, second, and third tubulars using the top drive while the third tubular is gripped by the slip.

20. The method of claim 18, further comprising:

actuating the slip back into the first position to release the third tubular;

lowering the apparatus with respect to the third tubular until an elevator is positioned at least partially positioned around the third tubular; and gripping the third tubular using the elevator.

21. A method for moving one or more tubulars, comprising:

positioning a U-shaped body and a slip carrier of an apparatus at least partially around a first tubular;

pivoting the slip carrier into a closed and locked position, preventing the first tubular from being removed laterally from the apparatus, wherein the slip carrier is pivoted with respect to a body of the apparatus;

actuating a slip that is coupled to the slip carrier vertically and radially from a first position into a second position to grip the first tubular, by actuating a cylinder which moves a main timing ring up and down;

indicating that the slips are in the second position using an indicating assembly, wherein the indicating assembly comprises:

a slip position indicator rod configured to move downward together with the main timing ring;

an indicator ramp coupled to and configured to move together with the slip position indicator rod; and a slip position indicator coupled to the body, wherein movement of the indicator ramp past the slip position indicator causes a signal to be transmitted, the signal representing that the slip is in the second position; and lifting the first tubular into a substantially vertical orientation using a top drive that is coupled to the apparatus while the first tubular is gripped by the slip.

* * * * *